US012635796B2

(12) United States Patent
Applegate et al.

(10) Patent No.: US 12,635,796 B2
(45) Date of Patent: May 26, 2026

(54) CHAIR TILT SYSTEM WITH LEAF SPRING

(71) Applicant: FELLOWES, INC., Itasca, IL (US)

(72) Inventors: Shawn M. Applegate, Streamwood, IL (US); Tai Hoon K. Matlin, Round Lake Beach, IL (US); Peter Maletich, Vancouver, WA (US)

(73) Assignee: FELLOWES, INC., Itasca, IL (US)

( * ) Notice: Subject to any disclaimer, the term of this patent is extended or adjusted under 35 U.S.C. 154(b) by 202 days.

(21) Appl. No.: 18/614,464

(22) Filed: Mar. 22, 2024

(65) Prior Publication Data

US 2024/0315448 A1 Sep. 26, 2024

Related U.S. Application Data

(60) Provisional application No. 63/454,215, filed on Mar. 23, 2023.

(51) Int. Cl.

| | |
|---|---|
| ***A47C 1/024*** | (2006.01) |
| ***A47C 1/032*** | (2006.01) |
| ***A47C 7/28*** | (2006.01) |

(52) U.S. Cl.

CPC ..... *A47C 1/024* (2013.01); *A47C 1/03277* (2013.01); *A47C 7/28* (2013.01)

(58) Field of Classification Search

CPC ..... A47C 1/03277; A47C 1/03266; A61G 5/1056; A61G 5/1075; A61G 5/107

USPC ..... 287/300.2, 313, 337, 339, 340

See application file for complete search history.

(56) References Cited

U.S. PATENT DOCUMENTS

| | | | | |
|---|---|---|---|---|
| 3,369,840 A * | 2/1968 | Dufton | ..... | A47C 1/03255 297/300.1 |
| 5,356,199 A | 10/1994 | Elzenbeck et al. | | |
| 6,250,715 B1 | 6/2001 | Caruso et al. | | |
| 7,425,037 B2 | 9/2008 | Schmitz et al. | | |

(Continued)

FOREIGN PATENT DOCUMENTS

| | | | | |
|---|---|---|---|---|
| DE | 102016104638 A1 * | 9/2017 | ..... | A47C 1/03277 |

OTHER PUBLICATIONS

International Search Report issued in corresponding International Application No. PCT/US2024/021268, dated Jun. 17, 2024.

(Continued)

*Primary Examiner* — Joshua D Huson
*Assistant Examiner* — Anna L. Gordon
(74) *Attorney, Agent, or Firm* — CUSHMAN PARTNERS, LLC

(57) ABSTRACT

A chair comprises a leaf spring for biasing a seat towards the substantially horizontal position and an adjustment mechanism comprises a front and rear support configured to adjust a force curve of the leaf spring. The front support to enable (a) the front end portion of the leaf spring to deflect upwardly for relieving at least a portion of an increase in a spring reaction force induced by downward movement of the rear support as the seat moves in the rearward tilting direction through a range of rearwardly tilted positions, and (b) the front support to deflect the front end portion of the leaf spring downwardly for restoring at least a portion of a decrease in the spring reaction force induced by upward movement of the rear support as the seat moves in the forward tilting direction through the range of rearward tilted positions.

9 Claims, 24 Drawing Sheets

(56) References Cited

U.S. PATENT DOCUMENTS

| | | | | |
|---|---|---|---|---|
| 10,624,457 | B2 | 4/2020 | Schmitz et al. | |
| 11,083,299 | B2 | 8/2021 | Matlin et al. | |
| 11,166,569 | B2 | 11/2021 | Schmitz et al. | |
| 2001/0011840 | A1* | 8/2001 | Caruso ..... | A47C 1/03238<br>297/302.1 |

OTHER PUBLICATIONS

International Preliminary Report on Patentability issued in International Patent Application No. PCT/US2024/021268, dated May 12, 2025.

* cited by examiner

CHAIR TILT SYSTEM WITH LEAF SPRING

CROSS-REFERENCE TO RELATED APPLICATIONS

This application claims the benefit under 35 USC 119(e) of prior U.S. Provisional Patent Application Ser. No. 63/454,215, filed Mar. 23, 2023, which is hereby incorporated by reference in its entirety.

BACKGROUND

Field

The present patent application relates to chairs, and particularly a chair that include a tilt system with a leaf spring.

Description of Related Art

Chairs are generally designed to support a user, for example, in a seat pan/base area and along a seat back area (including lumbar support). Chairs may include a base assembly, a seat base support member, a seat pan/base, and a seat back. Chairs may also include a tilt adjustment mechanism that is configured for adjusting the tilt of the seat base support member with respect to the base assembly. The tilt adjustment mechanism may be a rotational tilt mechanism that uses an adjustable torsional spring for adjusting the tilt of the seat pan/base member. Chairs may also include one or more tilt adjustment lever(s)/button(s) for adjusting the tilt of the seat pan/base member. The adjustment button (s)/lever(s) may be easily actuated by the user seated in the chair in order to operate the tilt adjustment mechanism.

To make a chair with tension adjustment, some manufacturers may enable only the seat back of the chair to recline, while the seat pan of the chair generally remains horizontal. Other manufacturers, may allow the chair to flex in conjunction with a four bar linkage.

For example, U.S. Pat. No. 7,425,037 ("the '037 Patent") discloses a chair with such a four bar linkage and a leaf spring. FIG. 98 of the '037 Patent shows an upright position of the chair, while FIG. 99 of the '037 Patent shows a rear tilt position of the chair. FIG. 9 in the present patent application shows an exemplary annotated view of the system of the '037 Patent showing various components of the '037 Patent, including, the four bar linkage, a leaf spring, a primary recline axis, a fixed rear/back point, a fixed front point, a pivot point (i.e., slide tension adjustment) between the rear/back point and the fixed front point, etc. The chair using the four bar linkage tilt system has multiple pivot points. The back of the chair tilts more than the angular displacement of the seat pan/base.

U.S. Pat. No. 10,624,457 ("the '457 Patent") discloses a leaf spring mechanism to which a self-adjustment feature is added. Referring to FIGS. 19-21 of the '457 Patent, the front of the leaf spring is locked/fixed in place. Additional springs 49*a*, 49*b of the* '457 Patent are configured to move to form a central adjustment point.

U.S. Pat. No. 11,166,569 ("the '569 Patent") discloses a chair in which an adjustment is provided by moving a spring flex point. FIG. 9 of the '569 Patent is reproduced and annotated as FIG. 20 in the present patent application to show various components of the system of the '569 Patent, including a leaf spring, a front point of the leaf spring that is fixed, a Bowden cable and knob that is manually adjusted and actuated by tilting the back of the chair, a chair back attachment point, a spring flex point (i.e., flex point that moves for a heavier user-towards the back of the chair, shortens a moment arm), a spring adjustment (i.e., gear tooth tension adjust), etc.

U.S. Pat. No. 5,356,199 ("the '199 Patent") discloses a locking adjustable leaf spring in a tilt mechanism for Office Chairs. The system of the '199 Patent discloses adjustment by compressing upwards to tension or preload the spring.

The present patent application endeavors to provide various improvements over known chairs.

SUMMARY

In one embodiment of the present patent application, a chair is provided. The chair comprises a base, a seat, a seat support structure, a leaf spring, and an adjustment mechanism. The seat comprises an upwardly facing seat pan and a forwardly facing seat back. The seat support structure is mounted to the base beneath the seat, the seat being movable in a rearward tilting direction from a substantially horizontal position through a range of rearwardly tilted positions. The leaf spring is disposed between the seat support structure and the seat for biasing the seat in a forward tilting direction towards the substantially horizontal position. The adjustment mechanism is configured to adjust a force curve of the leaf spring. The adjustment mechanism comprises a rear support, a front support, and an intermediate support. The rear support is operatively associated with a rear end portion of the leaf spring and connected to the seat. The front support is operatively associated with a front end portion of the leaf spring and connected to the seat support structure. The intermediate support is disposed between the front support and the rear support. The intermediate support is operatively associated with an intermediate portion of the leaf spring and is configured to support the intermediate portion of the leaf spring thereon. The leaf spring is bowed over the intermediate support concave downwardly between the front and rear end portions thereof to generate a spring reaction force such that an upward force is applied to the rear support by the rear end portion of the leaf spring to bias the seat in the forward tilting direction. The front support is mounted to move at least vertically in response to the seat moving in the forward and rearward tilting directions to enable (a) the front end portion of the leaf spring to deflect upwardly for relieving at least a portion of an increase in the spring reaction force induced by downward movement of the rear support as the seat moves in the rearward tilting direction through the range of rearwardly tilted positions, and (b) the front support to deflect the front end portion of the leaf spring downwardly for restoring at least a portion of a decrease in the spring reaction force induced by upward movement of the rear support as the seat moves in the forward tilting direction through the range of rearwardly tilted positions.

These and other aspects of the present patent application, as well as the methods of operation and functions of the related elements of structure and the combination of parts and economies of manufacture, will become more apparent upon consideration of the following description with reference to the accompanying drawings, all of which form a part of this specification, wherein like reference numerals designate corresponding parts in the various figures. In one embodiment of the present patent application, the structural components illustrated herein are drawn to scale. It is to be expressly understood, however, that the drawings are for the purpose of illustration and description only and are not intended as a definition of the limits of the present patent application. It shall also be appreciated that the features of one embodiment disclosed herein can be used in other embodiments disclosed herein. As used in the specification and in the claims, the singular form of "a", "an", and "the" include plural referents unless the context clearly dictates otherwise. In addition, as used in the specification and the claims, the term "or" means "and/or" unless the context clearly dictates otherwise. It should also be appreciated that some of the components and features discussed herein may be discussed in connection with only one (singular) of such components, and that additional like components which may be disclosed herein may not be discussed in detail for the sake of reducing redundancy.

Other aspects, features, and advantages of the present patent application will become apparent from the following detailed description, the accompanying drawings, and the appended claims.

BRIEF DESCRIPTION OF THE DRAWINGS

Various embodiments are disclosed, by way of example only, with reference to the accompanying schematic drawings in which corresponding reference symbols indicate corresponding parts, in which

FIG. 10A shows the weight distribution curve of a more complex highly adjustable mechanism per the user's preferences at the designated chair recline angles;

FIG. 17A shows stress distribution along the prior art leaf spring, while FIGS. 17B-17C show stress distributions along the leaf springs of the present patent application;

DETAILED DESCRIPTION OF THE DRAWINGS

Figure 1:
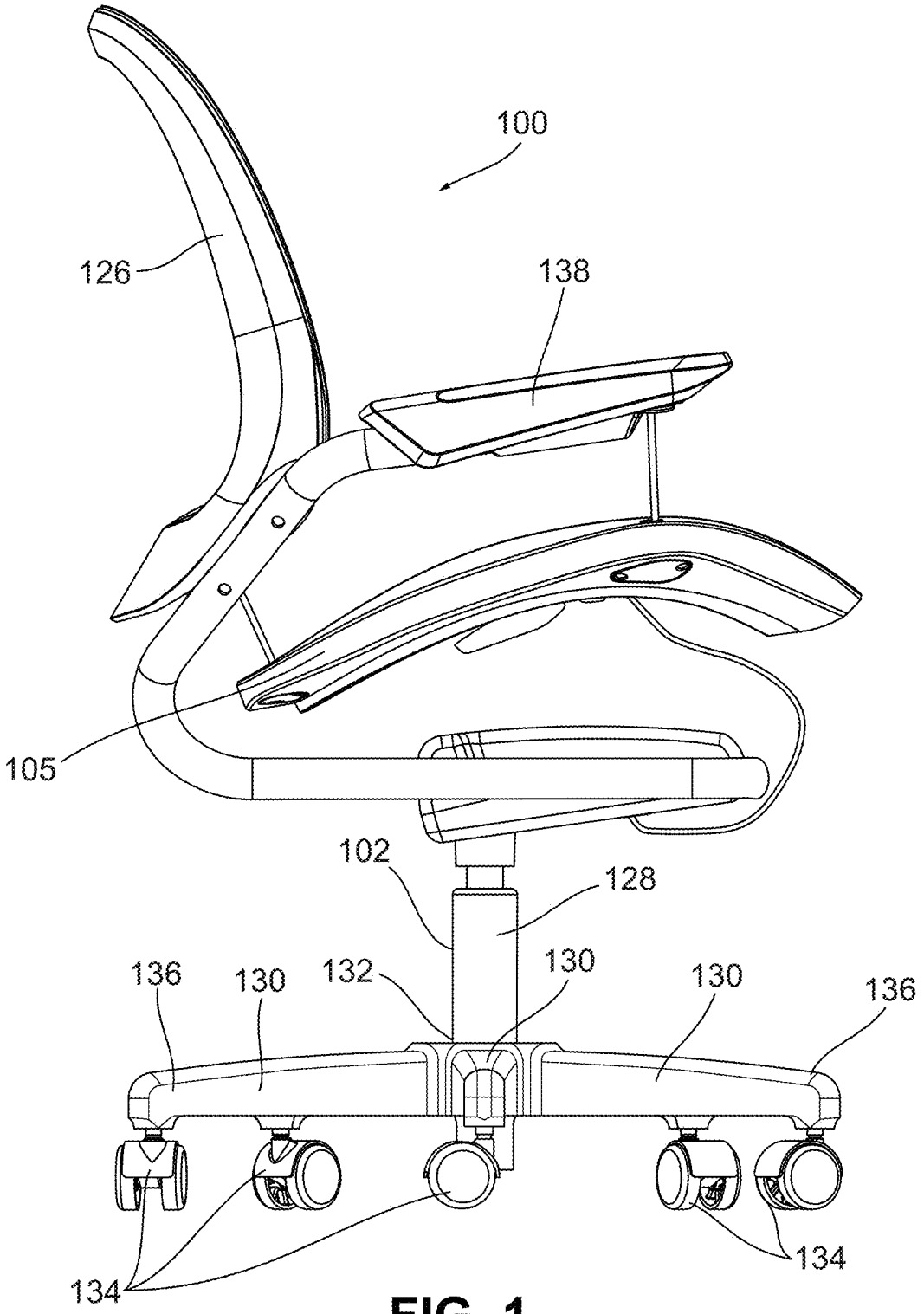
FIG. 1 shows a perspective view of an exemplary chair in accordance with an embodiment of the present patent application.
Figure 2:
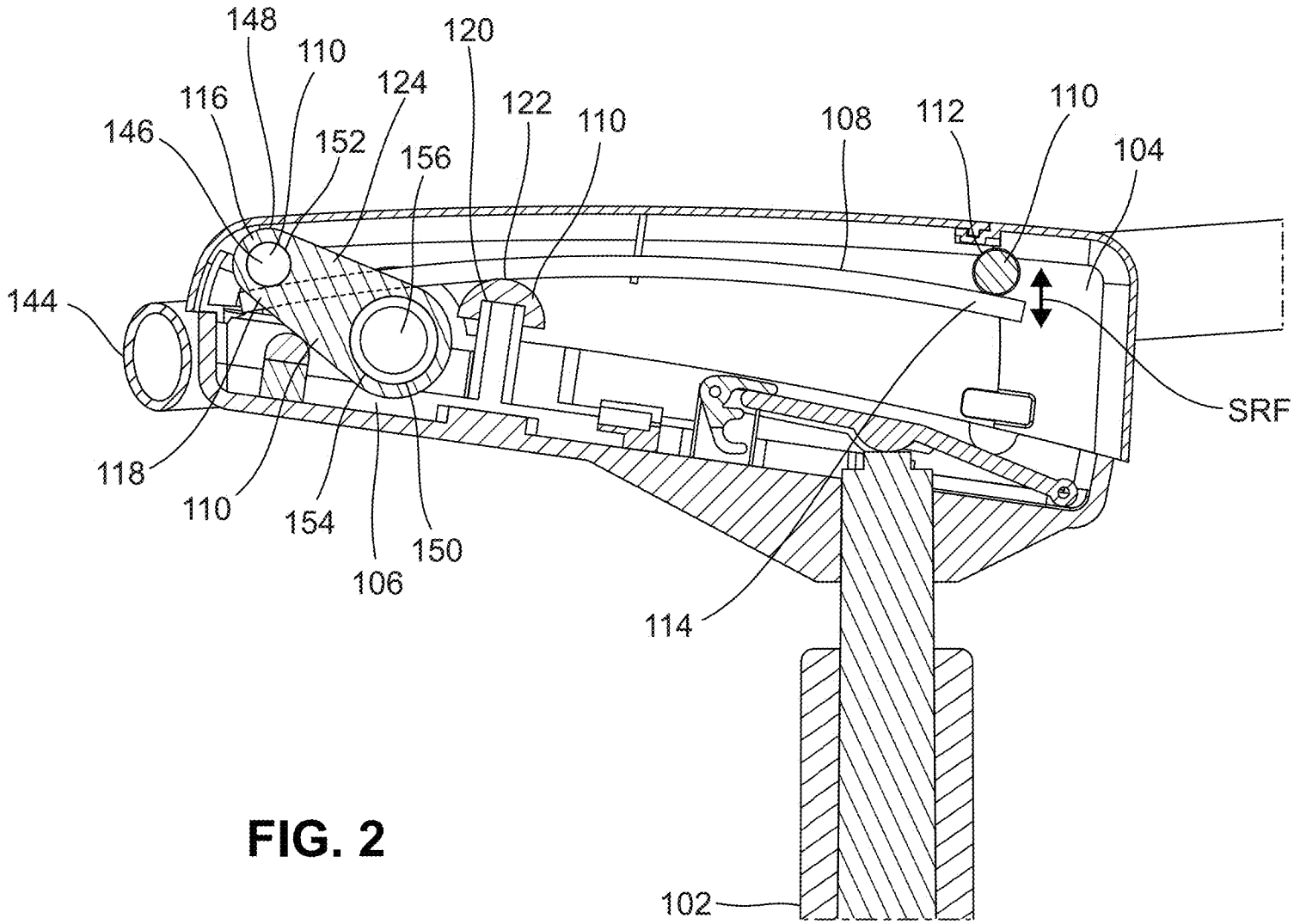
FIG. 2 shows a partial side view of an embodiment of the chair, where a seat pan is in a substantially horizontal position and a leaf spring biasing the seat pan in a forward tilting direction towards the substantially horizontal position in accordance with an embodiment of the present patent application.
Figure 3:
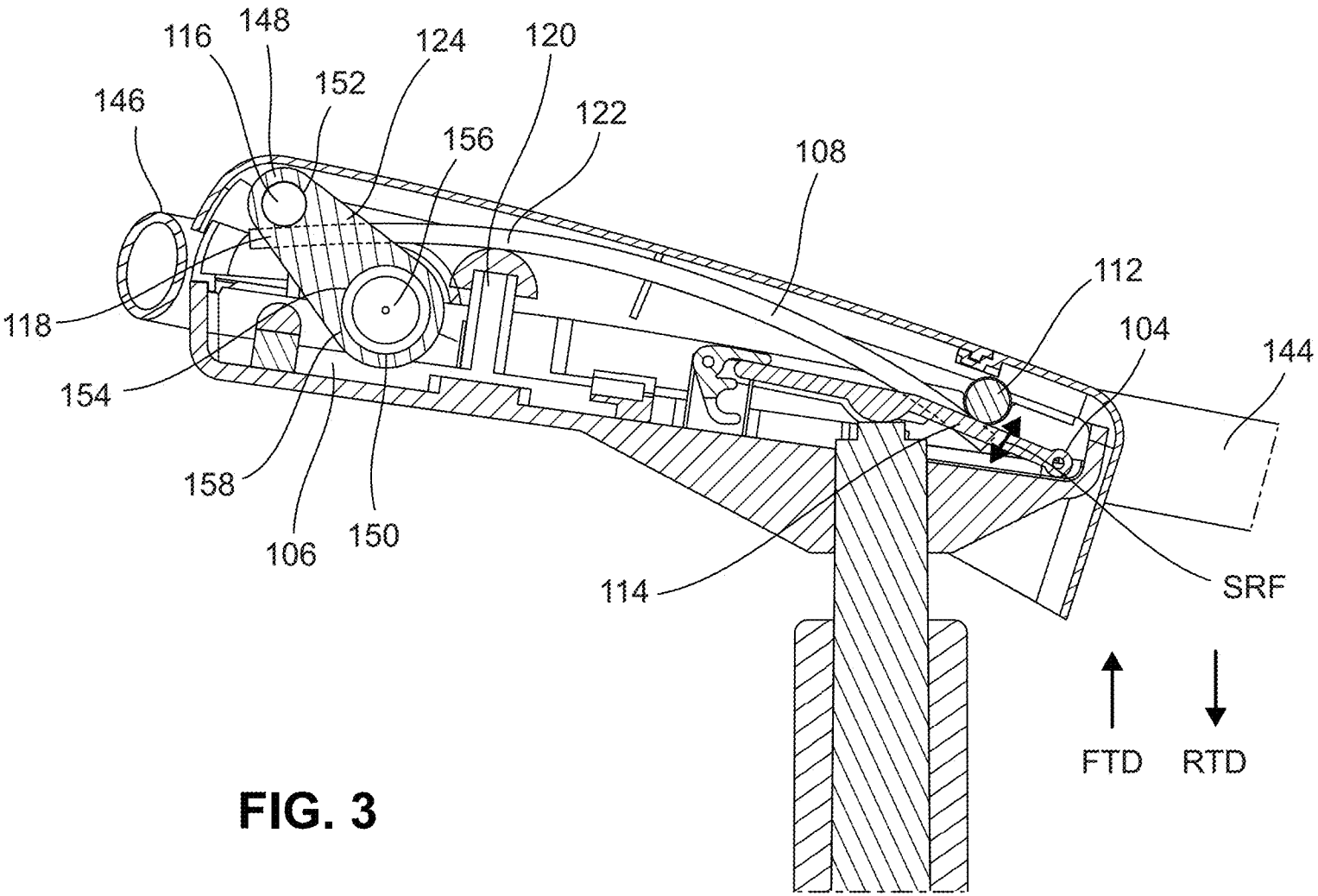
FIG. 3 shows another partial side view of the chair in FIG. 2, where the seat pan is moved in a rearward tilting direction from the substantially horizontal position to one of a range of rearwardly tilted positions in accordance with an embodiment of the present patent application.
Figure 4:
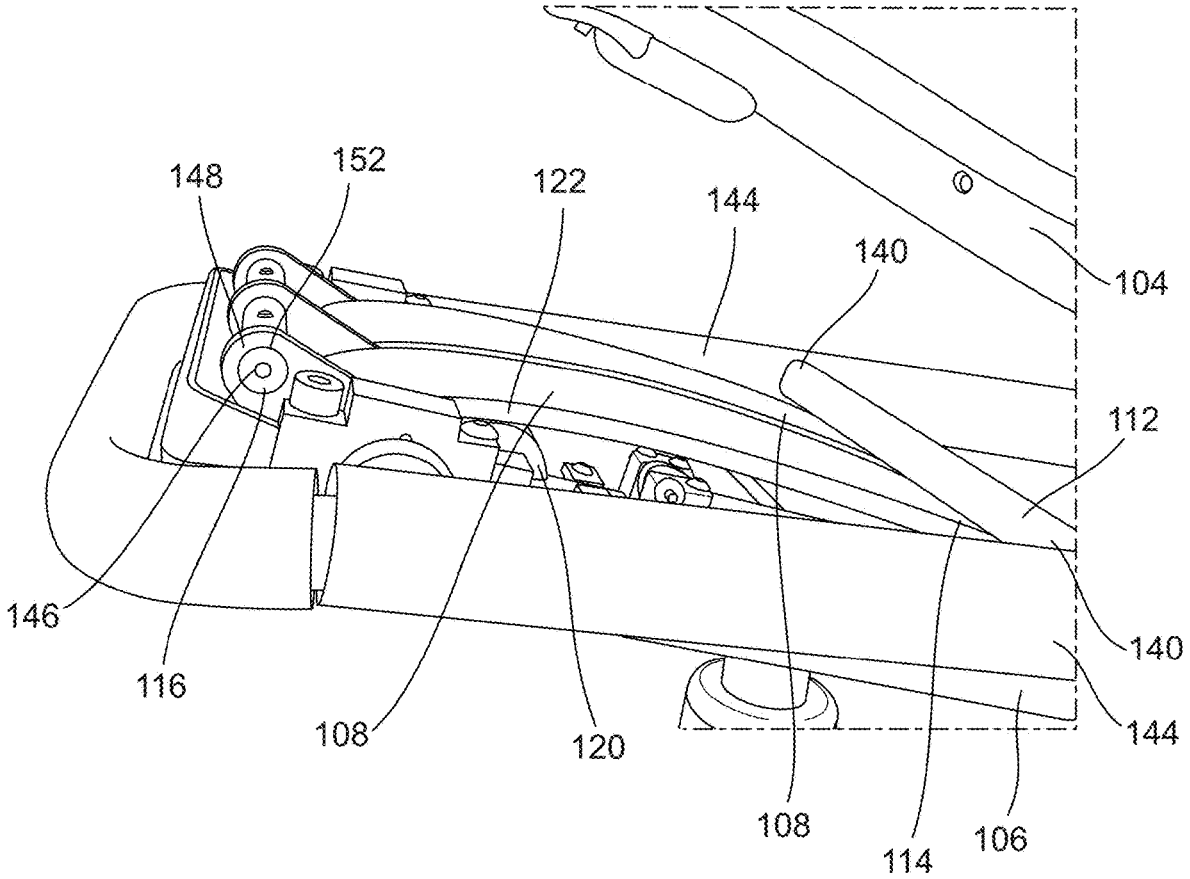
FIGS. 4 and 5 show perspective views of the chair, where the seat pan is moved in the rearward tilting direction from the substantially horizontal position through the range of rearwardly tilted positions in accordance with another embodiment of the present patent application.

FIGS. 1-4 show embodiments of chair 100 of the present patent application. These have common components, and thus common reference numbers are used for corresponding components. FIGS. 1 and 4 show a chair with a suspended seat pan, while FIGS. 2-3 show a chair with a more traditional seat pan that is supported from underneath, rather than by suspension. Further details as to differences between these designs are discussed below, and the principles of the present patent application may be applied to any type of chair design.

Figure 7:
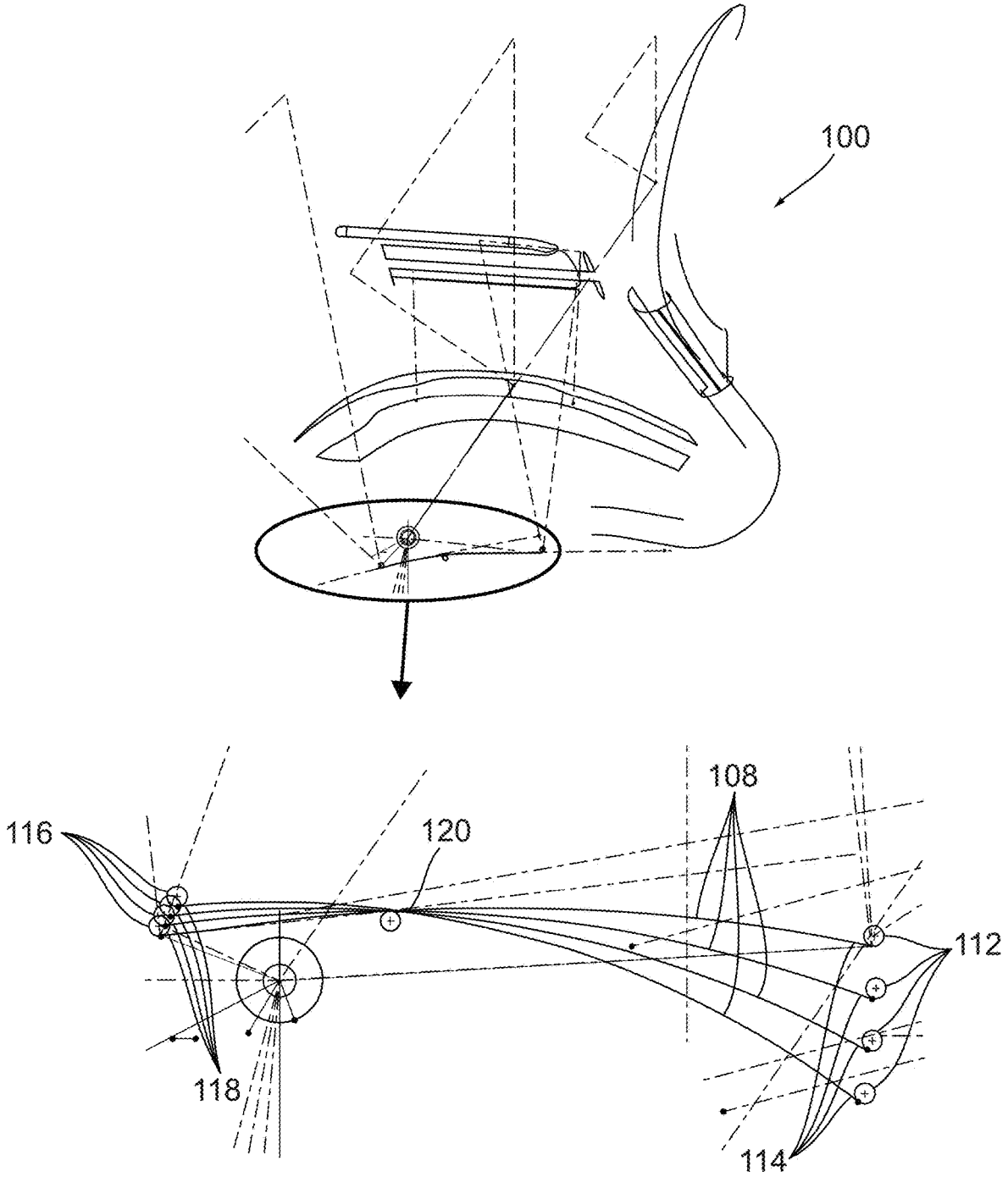
FIG. 7 shows a reference sketches of the chair, where the movement of the front support of the adjustment mechanism in at least vertical direction in response to the seat pan moving in the forward and rearward tilting directions is shown in accordance with an embodiment of the present patent application.

The chair 100 generally comprises a base 102, a seat comprising an upwardly facing seat pan 105 and a forwardly facing seat back 126, a seat support structure 106, a leaf spring 108, and an adjustment mechanism 110. The seat refers collectively to the seat pan 105 and the seat back 126, which may be of either the more traditional or suspended seat pan construction as mentioned above. The seat pan 105 is movable in a rearward tilting direction (e.g., in the direction of an arrow RTD) from the substantially horizontal position through a range of rearwardly tilted positions (e.g., as shown in FIG. 7). The seat support structure 106 is mounted to the base 102 beneath the seat pan 105. The leaf spring 108 is disposed between the seat support structure 106 and the seat pan 105 for biasing the seat pan 105 in a forward tilting direction (e.g., in the direction of an arrow FTD) towards a substantially horizontal position (as shown in FIG. 2). The adjustment mechanism 110 is configured to adjust a force curve of the leaf spring 108 based on the amount of the seat pan 105 has been tilted.

In designs where the seat pan 105 and seat back 126 are connected together in a more traditional manner, the tilting of the seat pan 105 also causes tilting of the seat including the seat back 126, whereas in a suspended design the frame including the seat back 126 is tilted and the seat pan 105 suspended thereon will also be tilted as the seat is tilted.

The adjustment mechanism 110 includes a rear support 112, a front support 116, and an intermediate support 120. The rear support 112 is operatively associated with a rear end portion 114 of the leaf spring 108 and is connected to the seat pan 105 in any suitable manner. The front support 116 is operatively associated with a front end portion 118 of the leaf spring 108 and is connected to the seat support structure 106 in any suitable manner. The intermediate support 120 is disposed between the front support 116 and the rear support 112. The intermediate support 120 is operatively associated with an intermediate portion 122 of the leaf spring 108 and is configured to support the intermediate portion 122 of the leaf spring 108 thereon. The leaf spring 108 is bowed over the intermediate support 120 so as to be curved and facing concave downwardly between the front and rear end portions 118, 114 thereof. This generates a spring reaction force SRF such that an upward force is applied to the rear support 112 by the rear end portion 114 of the leaf spring 108 to bias the seat pan 105 in the forward tilting direction FTD.

The front support 116 is mounted to move at least vertically in response to the seat pan 105 moving in the forward and rearward tilting directions. This enables the front end portion 118 of the leaf spring 108 to deflect upwardly for relieving at least a portion of an increase in the spring reaction force SRF induced by downward movement of the rear support 112 as the seat pan 105 moves in the rearward tilting direction RTD through the range of rearwardly tilted positions. Conversely, this also enables the front support 116 to deflect the front end portion 118 of the leaf spring 108 downwardly for restoring at least a portion of a decrease in the spring reaction force induced by upward movement of the rear support 112 as the seat pan 105 moves in the forward tilting direction FTD through the range of rearwardly tilted positions.

In one embodiment, as shown in FIGS. 2 and 3, the tilt system of the present patent application is shown to be used with a traditional chair (e.g., having the seat, the seat includes the seat pan 105 and the seat back 126 attached to the seat pan 105 (either directly or by a rigid or resilient connecting member) such that they move together as the user tilts forwardly and rearwardly. In this embodiment, the leaf spring 108 engages and supports the seat pan 105. That is, in FIGS. 2 and 3, the seat support structure 106 is supporting the seat pan 105 more directly and the seat back 126 is attached to the seat pan 105.

Figure 5:
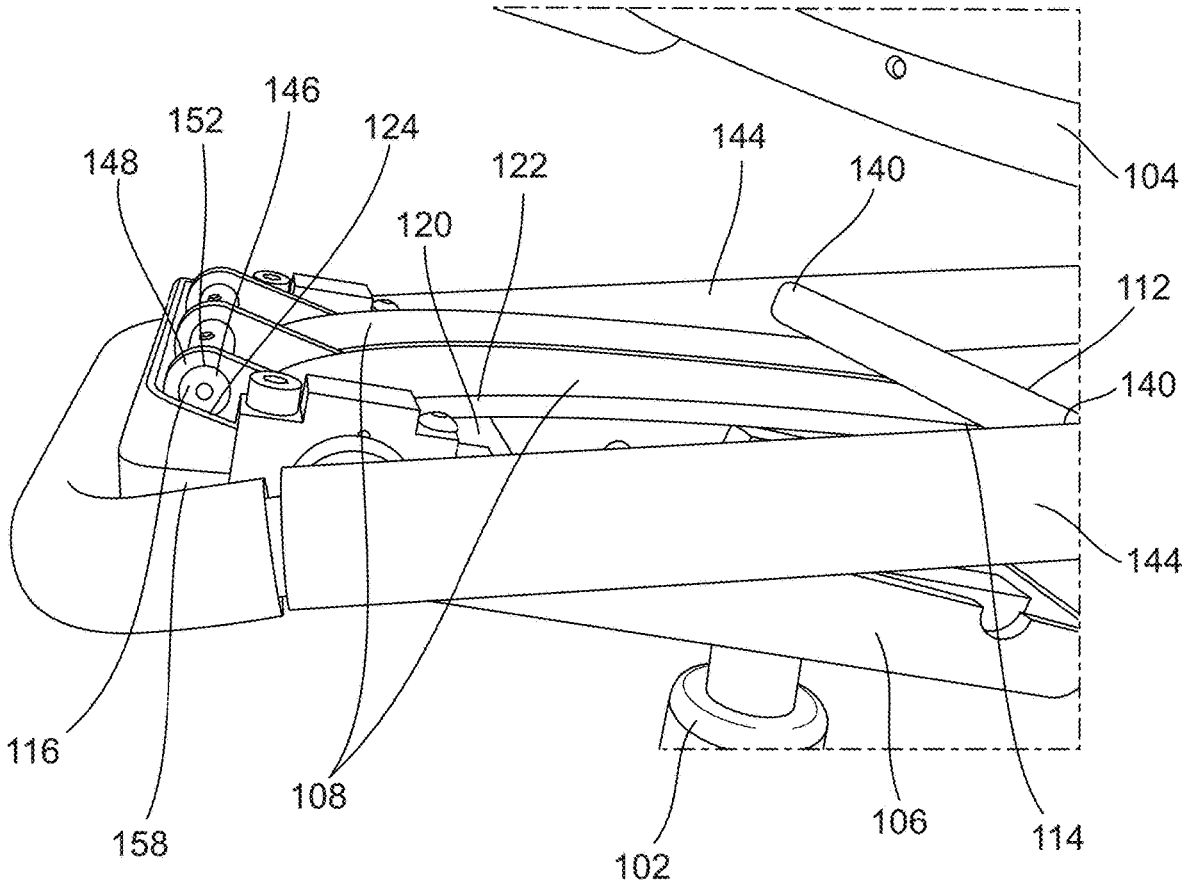
Figure 6:
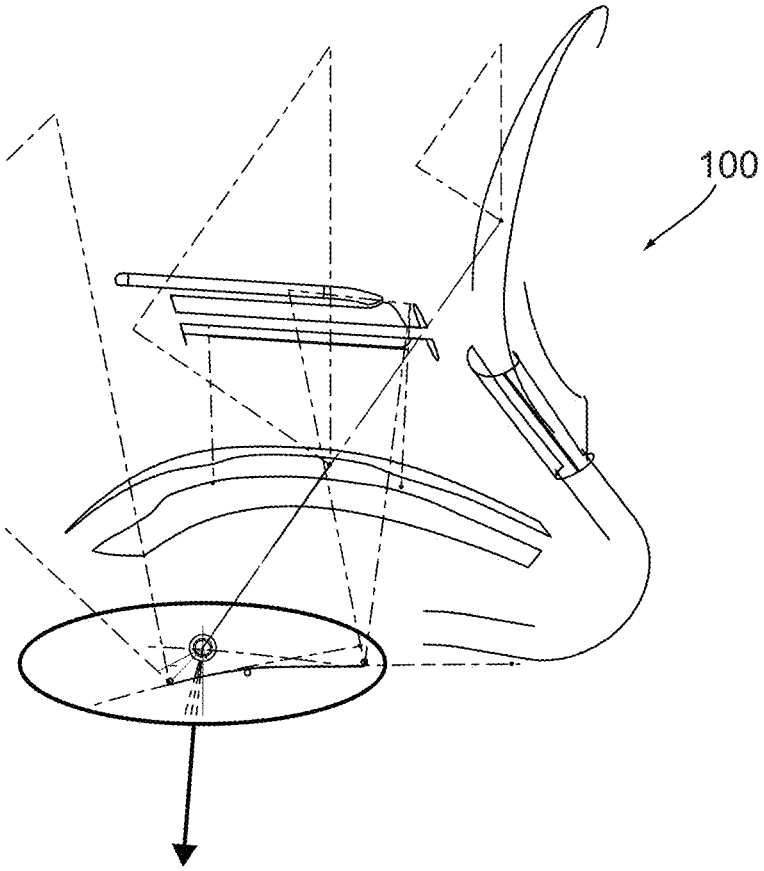
FIG. 6 shows a reference sketches of the chair, where operative associations between portions of the leaf spring and corresponding portions (e.g., a front support, a rear support and an intermediate support) of an adjustment mechanism that is configured to adjust a force curve of the leaf spring are shown in accordance with an embodiment of the present patent application.
Figure 6:
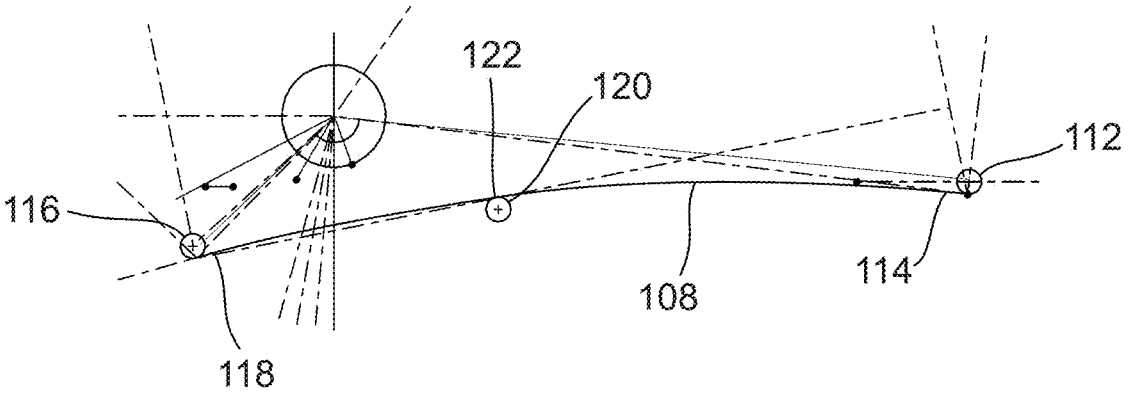

In another embodiment, as shown in FIGS. 1, 4 and 5, the tilt system of the present patent application is shown to be used with a chair having a suspended seat pan. The chair with the suspended seat pan is discussed in detail in U.S. Pat. No. 11,083,299 B2 ("the '299 Patent"), which is incorporated by reference in its entirety. For example, as described in the '299 Patent, the chair with the suspended seat pan includes a movement support frame, the movement support frame being supported on the base; and at least two movement support members configured to operatively connect the seat pan to the movement support frame. The seat support structure of the chair 100 of the present patent application may include the movement support frame of the suspended seat pan. In FIGS. 4-5, the seat support structure 106 is supporting the movement support frame of the suspended seat pan. In such an embodiment, the leaf spring 108 is not connected to the suspended seat pan but is connected to the movement support frame of the suspended seat pan. That is, the leaf spring 108, in this embodiment, engages and supports the movement support frame from which the seat pan is suspended. The leaf spring 108 is disposed between the seat support structure 106 and the movement support frame from which the seat pan is suspended. The seat back is on the movement support frame, while the seat pan is suspended from the movement support frame. The seat back 126 is operatively connected to the movement support frame.

In one embodiment, the base 102 of the chair 100 is configured to stably support the chair on a surface (e.g., a floor or ground). The base 102 includes an upright, support column member 128 and a plurality of base members 130 extending radially from a lower portion 132 of the upright support column member 128. The base 102 may be interchangeably referred to as base assembly. In the illustrated embodiment, the base 102 includes five base members 130 (i.e., legs). However, the number of base members 130 can vary as long as the number of base members is sufficient to provide stability to the chair 100. Each of the plurality of base members 130 has a caster wheel 134 positioned at its free end 136 thereof so as to facilitate the movement of the chair 100 along a surface (e.g., floor or ground). The configuration and design of the base 102 is not limiting, and any design to stably support the chair 100 on the surface may be used. In one embodiment, the caster wheels 134 are optional.

The seat pan 105 may interchangeably referred to as seat pan member. The seat pan 105 may be a substantially rigid structural member configured to support the weight of the user seated in the chair 100. The seat pan 105 is constructed to support thighs and bottom (buttocks) of the user while the user is seated in the chair 100. The seat pan 105 may also interchangeably referred to as seat base member. The seat pan 105 may include simple padded material or contoured padded material to provide comfort and support to the user's thighs and bottom. The seat pan 105 may include a peripheral frame member and engineered (contour forming) breathable mesh (e.g., elastomeric) material to provide comfort and support to the user's thighs and bottom. The design of the seat pan 105 is not intended to be limiting.

A rotational movement or displacement of the seat pan 105 generally refers to rotation of the seat pan 105 about one of three mutually perpendicular X, Y and Z axes (depending on the degrees of freedom permitted in a given embodiment). The rotations about the three mutually perpendicular X, Y and Z axes are generally referred to as roll (X-axis—extending front to back), pitch (Y-axis—extending laterally), and yaw (Z-axis—extending vertically), respectively. For example, the rotational movement or displacement of the seat pan 105 about the X axis generally refers to left or right side tilting movements of the seat pan 105. The rotational movement or displacement of the seat pan 105 about the Y axis generally refers to forward or rearward/backward tilting movements of the seat pan 105. The rotational movement about the Z axis generally refers to left or right turning movements of the seat pan 105. In one embodiment, the Z-axis is parallel to the height (from the base to the head rest) of the chair 100, the Y-axis is parallel to the width (from left to the right side) of the chair 100, and the X-axis is parallel to the length (from forward to the rearward/backward) of the chair 100. Not all embodiments need to have all degrees of freedom, and embodiments may be practiced with just the tilting movement about the Y-axis.

The seat pan 105 is movable in the rearwardly tilting direction RTD from the substantially horizontal position, which may happen directly as in the embodiment of FIGS. 2-3 where the seat pan 105 is engaged on the leaf spring 108 or indirectly where the frame with a suspended seat pan 105 is engaged on the leaf spring as in FIGS. 1 and 4-5. The substantially horizontal position of the seat pan 105 may include a position in which the seat pan 105 is in a horizontal seating plane. The horizontal seating plane generally includes a plane that is defined by the X and Y-axes and that is perpendicular to the Z-axis. The seat pan 105 is movable in the rearwardly tilting direction RTD from the substantially horizontal position refers to a rearward/backward tilting movement or displacement of the seat pan 105 about the Y axis from the substantially horizontal position.

The seat pan 105 in general is movable in the rearwardly tilting direction RTD from the substantially horizontal position through the range of rearwardly tilted positions. The range of rearwardly tilted positions include a plurality of rearwardly tilted positions between the substantially horizontal position and a maximum rearwardly tilted position. The spring reaction force generated by the leaf spring varies across the range of rearwardly tilted positions. That is, the spring reaction force of the leaf spring has a highest value at a rearwardly tilted position that is right before the maximum rearwardly tilted position, while the spring reaction force of the leaf spring has a lowest value at a rearwardly tilted position right that is right after the substantially horizontal position.

The seat support structure 106 is mounted to the base 102 beneath the seat pan 105. The seat pan 105 is configured to be moveable (e.g., in the rearward tilting direction from the substantially horizontal position through the range of rearwardly tilted positions) with respect to the seat support structure 106. As will be discussed in detail below, the front support 116 (via a portion of a control member 124) of the adjustment mechanism 110 is configured to be connected to the seat support structure 106. That is, a portion of the control member 124 of the adjustment mechanism 110 is configured to be pivotally connected to the seat support structure 106. Also, as will be discussed in detail below, the intermediate support 120 of the adjustment mechanism 110 is configured to be connected to the seat support structure 106.

The chair 100 may include a height adjustment mechanism 142 configured for adjusting the height of the seat base support structure 106 from the surface (e.g., floor or ground). In one embodiment, the height adjustment mechanism 142 may include a hydraulic mechanism, pneumatic mechanism, pressurized gas mechanism or mechanical mechanism (e.g., screw shaft assembly) for adjusting the vertical height of the seat base support structure 106 from the surface. In the illustrated embodiment, the height adjustment mechanism 142 includes a pneumatic cylinder assembly (i.e., gas charged piston/gas spring actuator). In one embodiment, the adjustment of the height of the seat base support structure 106 from the surface also adjusts the height of the seat pan 105 from the surface. The height adjustment mechanism 142 may include height adjustment lever(s)/button(s) for adjusting the height of the seat base support structure 106 from the surface. The adjustment button(s)/lever(s) may be easily actuated by the user seated in the chair 100 in order to operate the height adjustment mechanism 142. In one embodiment, the vertical height of the seat base support structure 106 from the surface with respect to the base assembly 102 may be adjusted by the user. The seat base support structure 106 may also be configured to be rotatable with respect to the base assembly 102 to allow the user to turn/revolve while seated in the chair 100.

In the embodiment of FIGS. 2-3, the leaf spring 108 is configured for biasing the seat pan 105 in the forward tilting direction FTD towards the substantially horizontal position of the seat pan 105. Biasing the seat pan 105 in the forward tilting direction FTD may include generating forward tilting movement or displacement of the seat pan 105 about the Y axis (i.e., towards the substantially horizontal position of the seat pan 105). As will be clear from the discussions below, the biasing the seat pan 105 in the forward tilting direction FTD may include applying the upward force on rearward portions of the chair frame 144 and/or the rear support 112 of the adjustment mechanism 110 by rearward portions 114 of the leaf spring 108. In the embodiments of FIGS. 1 and 4-5, the frame from which the seat pan 105 is suspended (and to which the seat back is also connected) is biased in the forward tilting direction by the rearward portions of the leaf spring 108 so as to bias the seat in general forwardly.

The leaf spring 108 may Include a single leaf spring. In the illustrated embodiment, the leaf spring 108 includes two leaf springs. The number of the leaf springs used in the chair 100 may vary. As will be clear from the discussions below, the leaf spring is configured to achieve a suitable range of adjustment to cover the span of user's weight ranges. That is, the leaf spring is configured to achieve a large adjustment range with less mechanical movement.

The material of the leaf spring 108 may include an epoxy impregnated fiber glass material. The leaf spring may include an epoxy impregnated unidirectional fiber glass bar with a minimum flex modulus rating of 5.1 (at 0.060 thickness). The leaf spring 108 may vary on composite percentages of materials, and may vary on the utilized thickness of the bar that is used to create the referenced leaf spring. The material of the leaf spring 108 may include carbon fiber layers/material. The material of the leaf spring 108 may include a composite of the carbon fiber material/layers and the epoxy impregnated fiber glass material. The materials and other properties of the leaf spring described herein should not be considered to be limiting.

The adjustment mechanism 110 is configured to adjust the force curve of the leaf spring 108 in response to the degree or amount of tilting. The adjustment mechanism 110 includes the rear support 112, the front support 116, the intermediate support 120 and the control member 124.

The rear support 112 of the adjustment mechanism 110 is operatively associated with the rear end portion 114 of the leaf spring 108. The rear support 112 may be interchangeably referred to as rear point, rear connection point, back connection point, back point or back support. The rear end portion 114 of the leaf spring 108 is positioned under the rear support 112 of the adjustment mechanism 110. That is, the rear end portion 114 of the leaf spring 108 is floating under the rear support 112, and due to its biasing force is engaged therewith to apply an upward force (and hence forward tilting).

The rear support 112 may include a support member (e.g., rod, shaft, etc.) that extends along the width (from the left side to the right side) of the chair 100 to be operatively associated with the rear end portion(s) 114 of the leaf spring(s) 108. The rear support 112 may be mounted in any manner, and may also be integrally formed as part of another structure. Referring to FIGS. 4-5, opposing end portions 140 of the rear support 112 may be connected to the frame for the suspended seat pan 105 and the seat back 126. As shown in FIGS. 4-5, the frame may include tubular member(s) 144 that are movable to enable the tilting of the seat pan 105 and seat back 126. The opposing end portions 140 of the rear support 112 may be connected to the tubular member(s) 144 of the seat pan 105. In the design of FIGS. 2 and 3, the rear support 112 is mounted directly under the seat pan 105 and may be connected or integrally formed therewith.

As described in the specification, the seat pan may be directly attached to frame member vs. "suspended". In another embodiment, the seat pan may be "attached" at varied points to supplement "suspended" configuration (or "optionally suspended"). In one embodiment, the dynamically adjusting leaf spring tilt mechanism of the present patent application may be used in any type of "chair" or "office chair".

The rear support 112 is configured such that, when the seat is moved in the rearward tilting direction RTD from the substantially horizontal position to a rearwardly tilted position, the rear support 112 is configured to move downward (in the rearward tilting direction RTD) to push (e.g., exert a downward force onto) the rear end portion 114 of the leaf spring 108 (in the rearward tilting direction RTD). The downwardly pushing in FIGS. 2 and 3 is caused directly by the downward movement of the seat pan 105's rear end as the user tilts back, and in FIGS. 1 and 4-5 it is caused by the downward movement of the frame from which the seat pan 105 is suspended as the user tilts back. The downward movement of the rear support 112 (with the seat pan 105) causes an increase in the spring reaction force SRF of the leaf spring 108.

Figure 11:
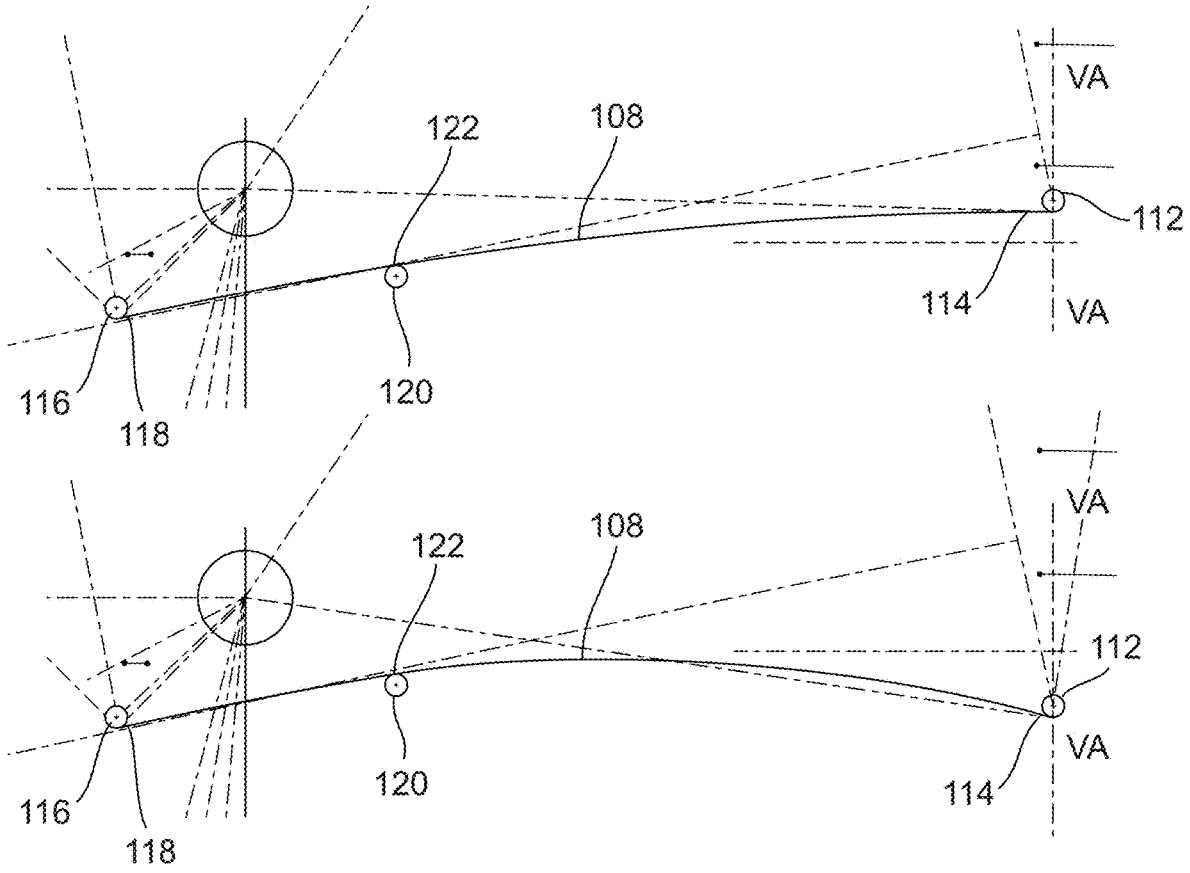
FIG. 11 shows reference sketches of the chair with a quick, user adjustable tension adjustment mechanism in accordance with an embodiment of the present patent application, where the user adjustable tension adjustment mechanism is configured to adjust tension in the leaf spring by moving the back/rear support/point up and down (generally along vertical direction), where some components/portions of the chair are not shown to better illustrate other components/portions of the chair.

In some embodiments, which will be described in detail with respect to FIGS. 11-16B, the rear support 112 may be adjustable to adjust the tension in the leaf spring 108. The adjustment of the rear support 112 may be up and down along a vertical axis (as shown in FIG. 11) or may be in and out along an axis with a predetermined angle (as shown in FIG. 14). Other tension adjustment approaches may be used, as discussed below (all of which are optional).

The front support 116 of the adjustment mechanism 110 is operatively associated with the front end portion 118 of the leaf spring 108. The front support 116 may be interchangeably referred to as front point or front connection point. The front end portion 118 of the leaf spring 108 is positioned under the front support 116 of the adjustment mechanism 110. That is, the front end portion 118 of the leaf spring 108 is floating under the front support 116 and engaged therewith to apply a biasing that tends to tilt the seat rearwardly. However, because the front support 116 is closer to the intermediate support 120 than the rear support 112, it has less mechanical leverage and therefore the overall or net bias of the leaf spring 108 tends to be in the forward direction due to the greater mechanical leverage created by the distance between the rear support 112 and the intermediate support 120.

Unlike the prior art systems discussed in the background section of the present patent application, the front support 116 of the present patent application is not fixed. As will be clear from the discussion below, the front connection point to the leaf spring 108 is a long cam (the control arm/member 124) and this configuration enables the front support 116 to move and to not be fixed. As the user reclines, the front support 116 either is raised or rises. This flattens the force curve of the leaf spring 108 and more closely matches the more complex four bar linkage disclosed in the prior art without the attendant complexity. The lifting of the front end 116 of the leaf spring 108 relieves at least a portion of the stress due to the pivot arm 124 and its proximity to mid-point 120 (interchangeably referred to as the spring bend point). That is, note the shorter distance to the mid-point vs. the distal loose end of the leaf spring 108).

For example, the front support 116 is mounted to move at least vertically in response to the seat pan 105 hanging from and/or assembled to the frame member 144 residing above mechanism cover 104 moving in the rearward tilting directions. For example, in the embodiments of FIGS. 2 and 3, the front support 116 is engaged underneath the mechanism cover 104 and moves vertically upwards when the seat pan 105 is moved in the rearward tilting direction RTD from the substantially horizontal position to a rearwardly tilted position. That is, the front support 116 enables the front end portion 118 of the leaf spring 108 to deflect upwardly for relieving at least a portion of an increase in the spring reaction force SRF induced by downward movement of the rear support 112 as the seat pan 105 moves in the rearward tilting direction RTD through the range of rearwardly tilted positions. Thus, as the rear support 112 pushes the rear end portion 114 of the leaf spring 108 rear and down to increase the bending stress is the leaf spring 108 (and hence the spring reaction force SRF), the front support 116 rises to let the front end portion 118 of the leaf spring 108 lift to reduce the bending stress, thus relieving or offsetting at least a portion of the increase.

The front support 116 is also configured to move vertically downwards when the seat pan 105 is moved/biased in the forward tilting direction FTD. That is, the front support 116 deflects the front end portion of the spring downwardly for restoring at least a portion of a decrease in the spring reaction force SRF induced by upward movement of the rear support 112 as the seat pan 105 moves in the forward tilting direction FTD through the range of rearwardly tilted positions.

The front support 116 may include a support member (e.g., rod, shaft, etc.) that extends along the width (from the left side to the right side) of the chair 100 to be operatively associated with the front end portion(s) 118 of the leaf spring(s) 108. Portions 146 of the front support 116 are received in opening(s) 152 of first end portions 148 of the control member 124. In FIGS. 4 and 5, because the seat pan 105 is suspended, the front support 116 is not engaged under the seat pan 105. Instead, the lower end(s) of the control arm(s) 124 is fixed to a shaft that pivots with the frame member 144 as the frame from which the seat pan 105 is suspended in general is tilted. This moves the control arm or arms 124 in the same manner such that the front support 116 rises with at least a vertical component as the seat pan 105 is tilted rearwardly to offset at least a portion of the increase in the spring 108's bending stress induced by the downward movement of the rear support 112. Likewise, as the seat pan 105 is tilted forwardly the front support 116 also moves downwardly to deflect the front end portion of the spring 108 downwardly for restoring at least a portion of a decrease in the spring reaction force SRF induced by upward movement of the rear support 112.

The intermediate support 120 of the adjustment mechanism 110 is disposed between the front support 116 and the rear support 112. The intermediate support 120 may be interchangeably referred to as midpoint, mid connection point, mid support, pivot point, spring support, or spring point. The intermediate support 120 is operatively associated with an intermediate portion 122 of the leaf spring 108 and is configured to support the intermediate portion 122 of the leaf spring 108 thereon.

The leaf spring 108 is bowed over the intermediate support 120 concave downwardly between the front and rear end portions 118, 114 thereof to generate a spring reaction force SRF such that an upward force is applied to the rear support 112 by the rear end portion 114 of the leaf spring 108 to bias the seat in the forward tilting direction FTD.

In one embodiment, the intermediate support 120 is fixed with respect to the seat support member 106. In some embodiments, as an option the intermediate support 120 may be adjusted between two or more predetermined heights. For example, in such an embodiment, the intermediate support 120 may be fixed with respect to the seat support member 106 at one of the two or more predetermined heights. The adjustment of the intermediate support 120 between the two or more predetermined heights is optional. An optional tool can be used either to raise or to lower the intermediate support 120 to one of the two or more predetermined heights. The adjustment of the intermediate support 120 between the two or more predetermined heights enables to adjust the tension in the leaf spring 108. In another embodiment, the intermediate support 120 may be moved from front to back to the location of the point where the leaf spring 108 bends (e.g., like how a diving board gets adjusted). These are alternative options for adjusting the tension curve for the spring 108 to better suit users of different weights or weight ranges.

The control member 124 of the adjustment mechanism 110 may be interchangeably referred to as control arm. The control member 124 includes the first end portion 148 and opposing second end portion 150. The first end portion 148 includes the opening 152 that is configured to receive the portions 146 of the front support 116. The second end portion 150 includes an opening 154 that is configured to receive a pivot pin 156 that pivotally connects the second end portion 150 of the control member 124 to the seat support member 106. Control member 124 can optionally be adjustable to rotated clockwise and counterclockwise (using the reference of 156's center point as the center of rotation) as to change the position of front support 116 and first end portion 148 in relationship to mid-point; counterclockwise pivotal movement of control member 124 using the center point reference adds additional tension to leaf spring 108 whereas clockwise movement relieves tension. This type of tension adjustment, with and without an adjustable torsion spring, can be used in unison or independently of the other disclosed tension adjustment methods. This allows for adjustment of the rotation threshold (force) of control member 124.

The control member 124 is interconnected to the seat pan 105 for movement therewith by way of frame member 144 and as seat pan 105 moves in the forward and rearward tilting directions. For example, as discussed above, in FIGS. 2-3 the first end portion 148 of the control member 124 is configured to be connected to seat pan 105 for movement therewith as the seat pan 105 moves in the forward and rearward tilting directions FTD, RTD. Likewise, as discussed above, in the embodiment of FIGS. 1 and 4-5 the other end of the control member 124 is connected to a member 144 of the seat frame so that the control member 124 is pivoted as the seat frame pivots.

As mentioned above, the first end portion 148 of the control member 124 is configured to move vertically upwards when the seat pan 105 is moved in the rearward tilling direction RTD from the substantially horizontal position to a rearwardly tilted position. The front support 116 is connected to (the first end portion 148 of) the control member 124 such that the control member 124 moves the front support 116 at least vertically in response to the seat moving in the forward and rearward tilting directions FTD, RTD.

The control member 124 is a pivotable control member 124 that is pivotally connected to the seat support structure 106 and is connected to the seat pan 105 for pivotal movement by way of frame member 144 as the seat pan 105 moves in the forward and rearward tilting directions FTD, RTD.

Figure 8:
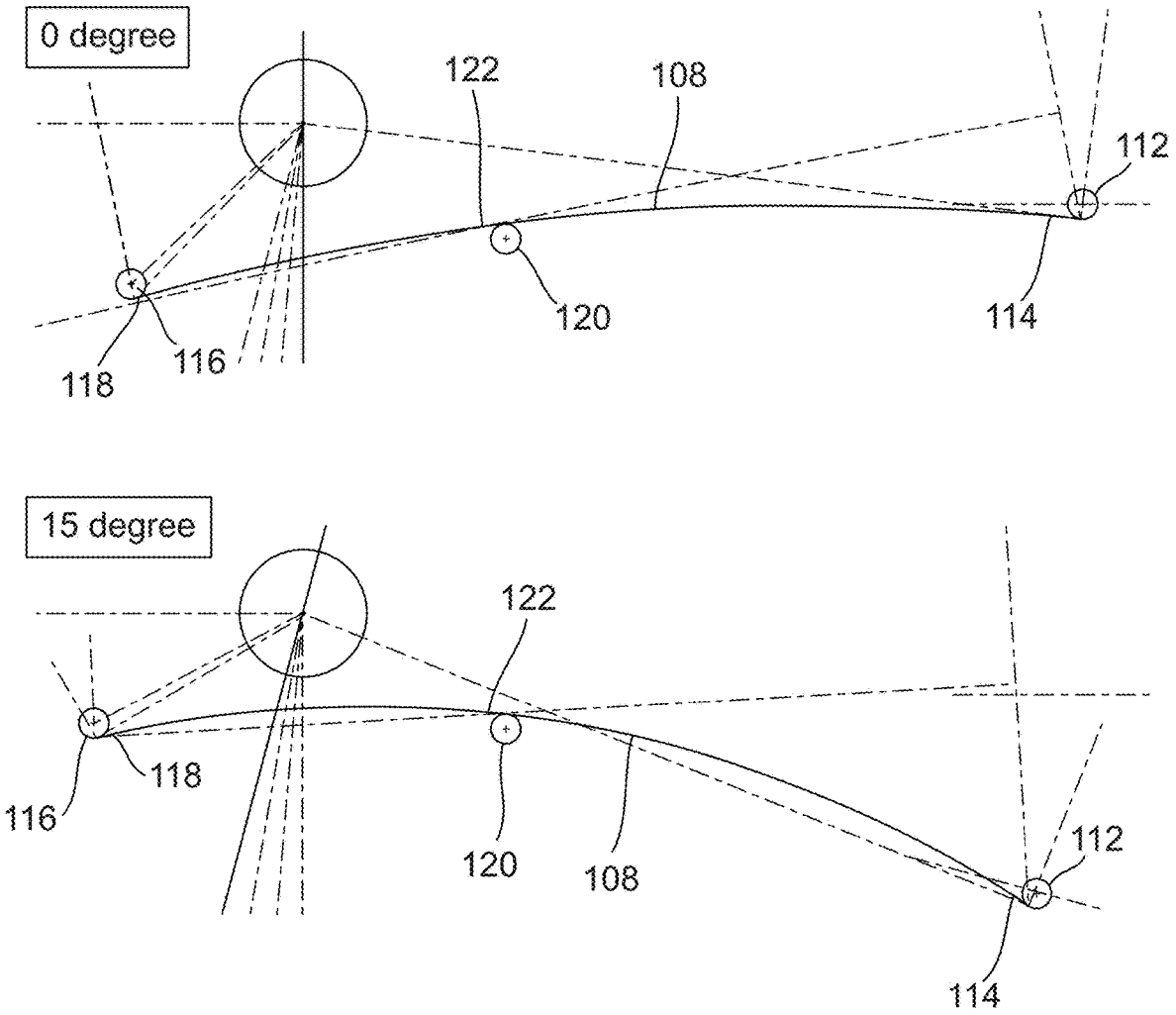
FIG. 8 shows a reference sketches of the chair, where operative associations between the adjustment mechanism and the leaf spring at 0 degree recline angle and 15 degree recline angle, where some components/portions of the chair are not shown to better illustrate other components/portions of the chair.

FIG. 8 shows exemplary views of the chair showing operative associations between the adjustment mechanism and the leaf spring at a recline angle of 0 degree and at a recline angle of 15 degree. As the user reclines in the chair 100, the back portion of the seat pan 105 drops as the front support 116 connected thereto raises. This flattens the force curve of the leaf spring 108 as discussed above.

In one embodiment, the chair 100 has no need for a tension adjustment. That is, the chair 100's unique leaf spring force curve balancing actuation is configured to work comfortably for most users having weight in the range of between 90 pounds (lbs) and 250 lbs. The chair 100 due to its broad tension zone some additional adjustment may also be configured to provide a very quick automatic tension adjustment or an automatic or intuitive tension adjustment if needed for those whom sitting comfort preference reside outside the main force curve zone.

Figure 9:
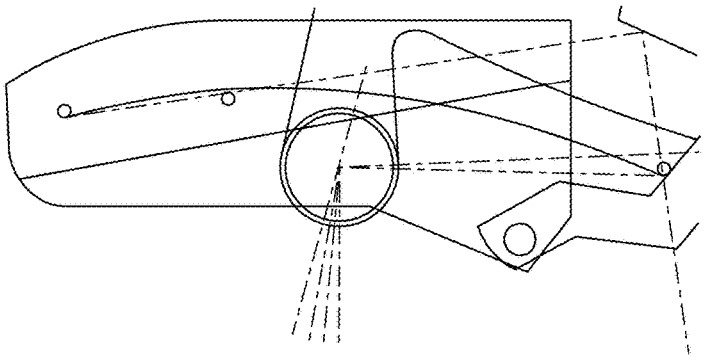
FIG. 9 (PRIOR ART)
FIG. 9 shows a partial side view of a prior art chair having a leaf spring and a four bar linkage.
Figure 19:
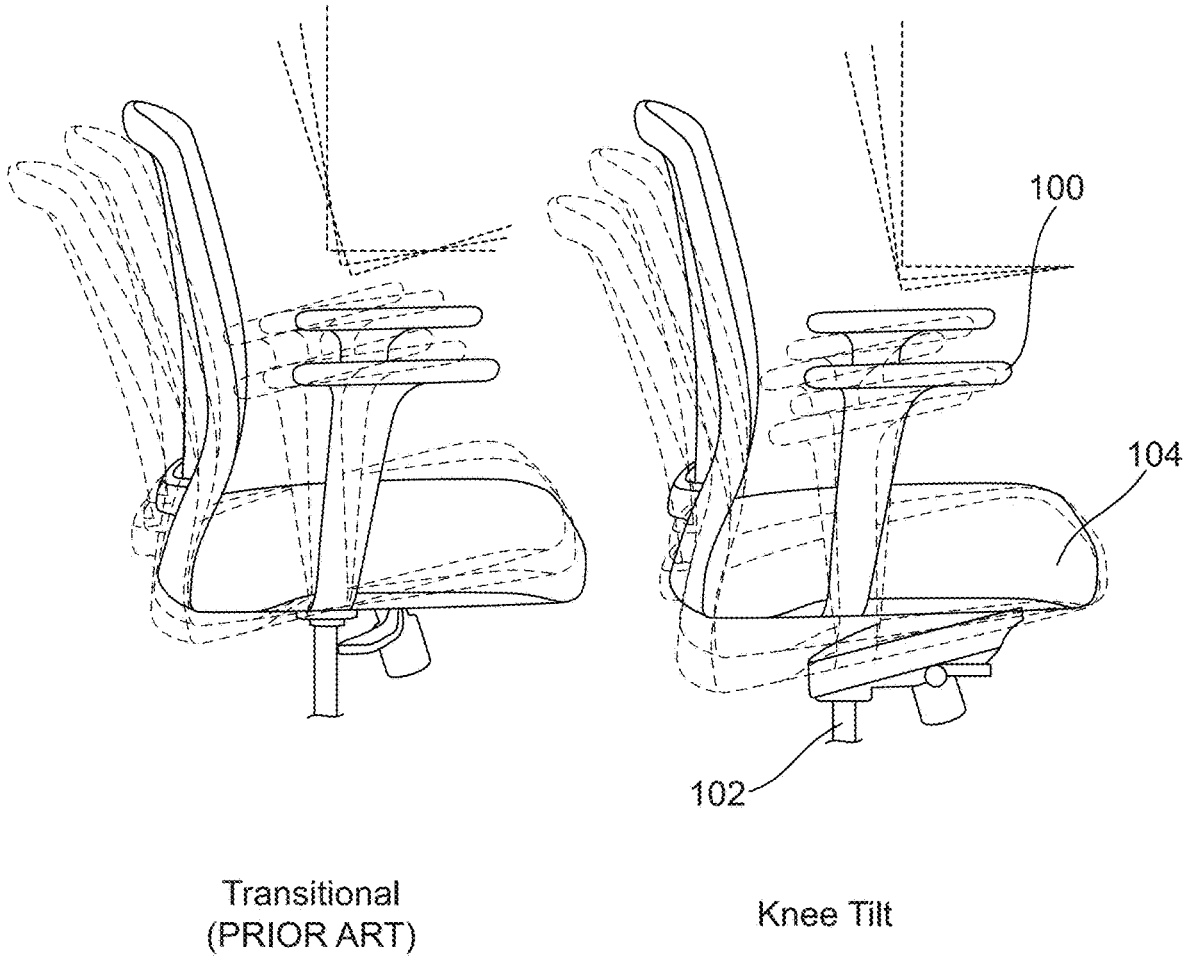
FIG. 19 shows the differences between the prior art traditional pivot point mechanism and a knee tilt mechanism.
Figure 20:
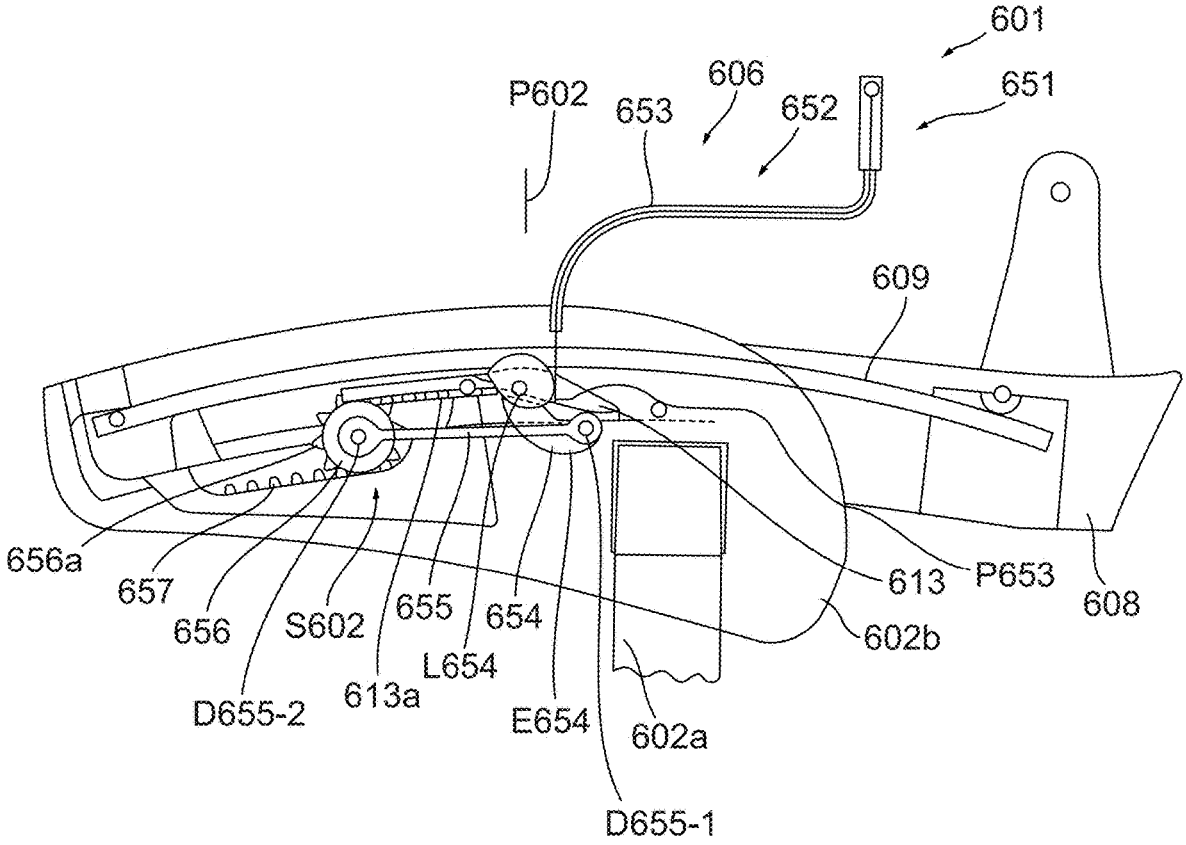
FIG. 20 (PRIOR ART)
FIG. 20 shows a prior art chair system.

In some embodiments, the chair 100 may be characterized as having a knee tilt mechanism (i.e., pivot point that is located more forwardly, and towards the front where the user's knees are located). For example, the knee tilt mechanism allows the user's feet to remain flat on the surface (e.g., floor or ground) while the back of the chair is in recline. Also, the pivot point for the knee tilt mechanism is at the front of the chair rather than in the middle of the seat. The prior art chair of the '037 Patent (e.g., as shown in FIG. 9 of the present patent application) employs a traditional pivot point mechanism and not a knee tilt mechanism. FIG. 19 shows the differences between the traditional pivot point mechanism and a knee tilt mechanism.

The chair 100 include tube frame design with a single point knee tilt pivot. The back of the chair 100 and the angular displacement of the seat pan 105 is generated from the single pivot point.

The chair 100 include a portion 158 (as shown in FIG. 3) that is configured to bridge a gap between the mechanism cover 104 (when the seat pan 105 is the rearward tilted positions) and the seat support structure 106. The portion 158 may be interchangeably referred to as a shield portion that is configured to shield a gap between the mechanism cover 104 (when the seat pan 105 is the rearward tilted positions) and the seat support structure 106. The portion 158 is configured to prevent user's clothes or other things from getting caught within the mechanism assembly (when the seat pan 105 is the rearward tilted positions) and the seat support structure 106. The portion 158 may be operatively connected to the mechanism cover 104 so as to move along with the mechanism cover 104 when the seat pan 105 moves in the rearward tilting direction from the substantially horizontal position through the range of rearwardly tilted positions. The same shield portion 158 may be used in the suspended seat embodiment, such as shown in FIG. 5, to shield the control arms 124 and the gap between the seat support structure 106 and the front support 116 for the same purpose.

Figure 10:
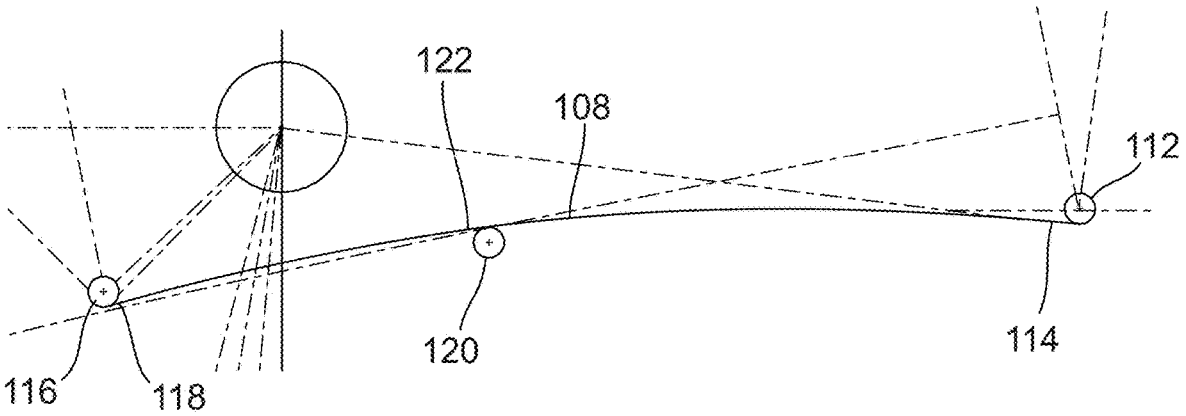
FIG. 10 shows a reference sketch of the chair of the present patent application for comparison with the prior art chair shown in FIG. 9, where operative associations between portions of the leaf spring and the portions (e.g., the front support, the rear support and the intermediate support) of the adjustment mechanism, which is configured to adjust a force curve of the leaf spring, are shown, where some components/portions of the chair are not shown to better illustrate other components/portions of the chair.

The present patent application provides a way to dynamically adjust tension in the leaf spring 108 responsive to the tilting action so the force curve of the leaf spring 108 remains reasonably consistent throughout the weight ranges of the users. Different preload methods are also discussed below in detail to maintain the force curve of the leaf spring 108 across the full range of the weights of the users. In the present patent application, as an option, the rear support 112 is movably adjusted to adjust the bending stress in the leaf spring 108, or the adjustments to the intermediate support 120 may also be used (or they may be used in combination for more fine-tuned adjustments). The leaf spring tilt of the present patent application with the dynamically moving adjustment may be applied to a standard pivot chairs (e.g., FIG. 9) as well, by moving pivot point (as shown in FIG. 10) more towards the center point of the leaf spring. The dynamically adjusting tension assembly may be applied to emulate standard tilting as well as knee tilt mechanism.

Figure 10A:
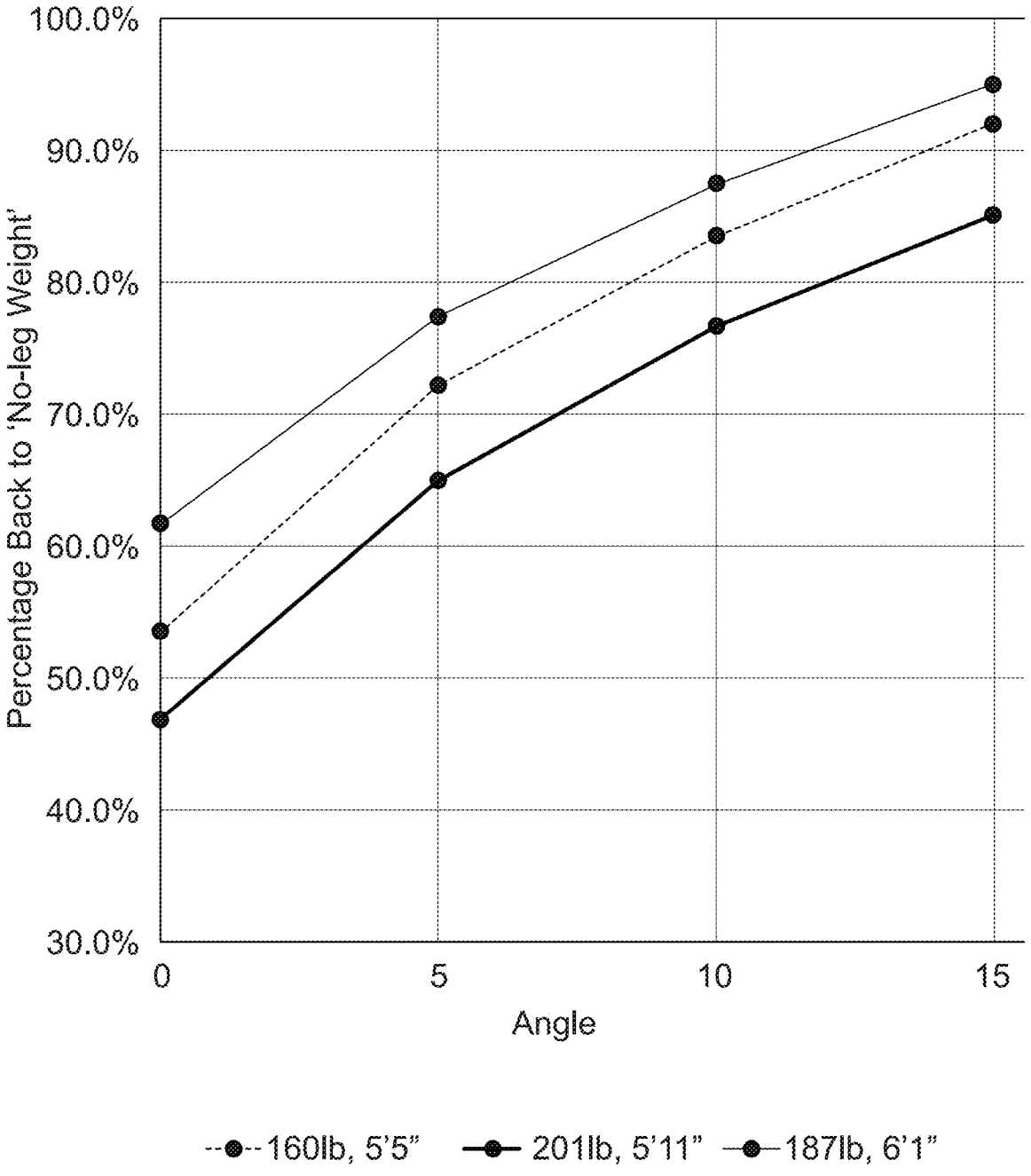
FIG. 10A is a graph that shows how much of the user's weight is distributed to the back vs. their overall 'no-leg' weight (e.g., a portion of their total weight) in accordance with an embodiment of the present patent application, where

FIG. 10A is a graph that shows how much of the user's weight is distributed to the user's back vs. the user's overall 'no-leg' weight (e.g., a portion of their total weight). FIG. 10A represents the weight distribution curve of a more complex highly adjustable mechanism per the user's preferences at the designated chair recline angles. This data curve was then used to determine the optimal geometry of the disclosed tilt system with leaf spring. A few users were weighed on the scale (i.e., total weight). A chair was placed on a scale with the users seated thereon (i.e., feet flat on the ground (and not resting on the scale)), the users weights were measured as their sitting weights. Across the users measured, roughly 20-22% of the total user weight was from their legs. That is, a 200 lbs user, would apply 160 lbs to the chair when he/she was sitting in the chair. The same user sat in the same chair to record their personally preferred tension setting. This tension setting was then used to establish a calculated force curve per their weight, tension setting and the four charted back tilt angles of 0, 5, 19, 15 degrees.

FIG. 11 shows reference study views of the chair 100 with a quick, user adjustable tension adjustment mechanism for the chair 100. That is, FIG. 11 shows reference sketch for the backside or distal end of the leaf spring to be engaged to preload the leaf spring. For example, the user adjustable tension adjustment mechanism is configured to adjust tension in the leaf spring 108 by moving the back/rear support/point 112 up and down (generally along vertical direction, e.g., along the vertical axis VA-VA). The user may adjust the rear support 112 up or down (along the vertical axis VA-VA) more easily in the non-seated position, a standard rotational adjustment can be used to move rear support/point up and down the path of vertical axis VA-VA, or any similar type of mechanism to advance rear support 112 up and down, prior to sitting or re-engaging with seat pan 105 or the seat suspension frame (so as to move the rear support 112 along with the seat pan 105 in the forward and rearward tilting directions). Comparing the two figures in FIG. 11, the rear support 112 in the upper figure of FIG. 11 is adjusted to be at a higher initial position (along the vertical axis VA-VA), while the rear support 112 in the lower figure of FIG. 11 is adjusted to be at a lower initial position (along the vertical axis VA-VA).

Figure 12:
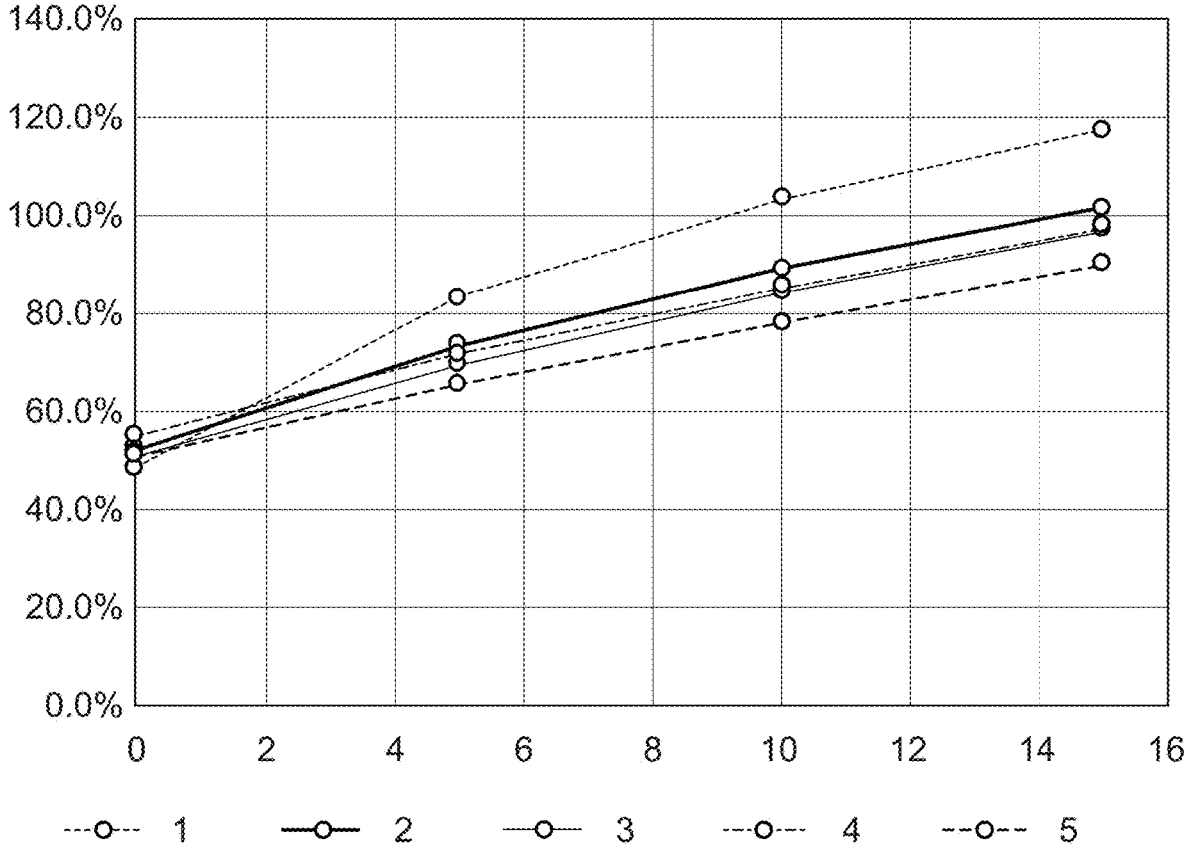
FIG. 12 shows results of the user adjustable tension adjustment mechanism shown in FIGS. 11, 13A and 13B.
Figure 13A:
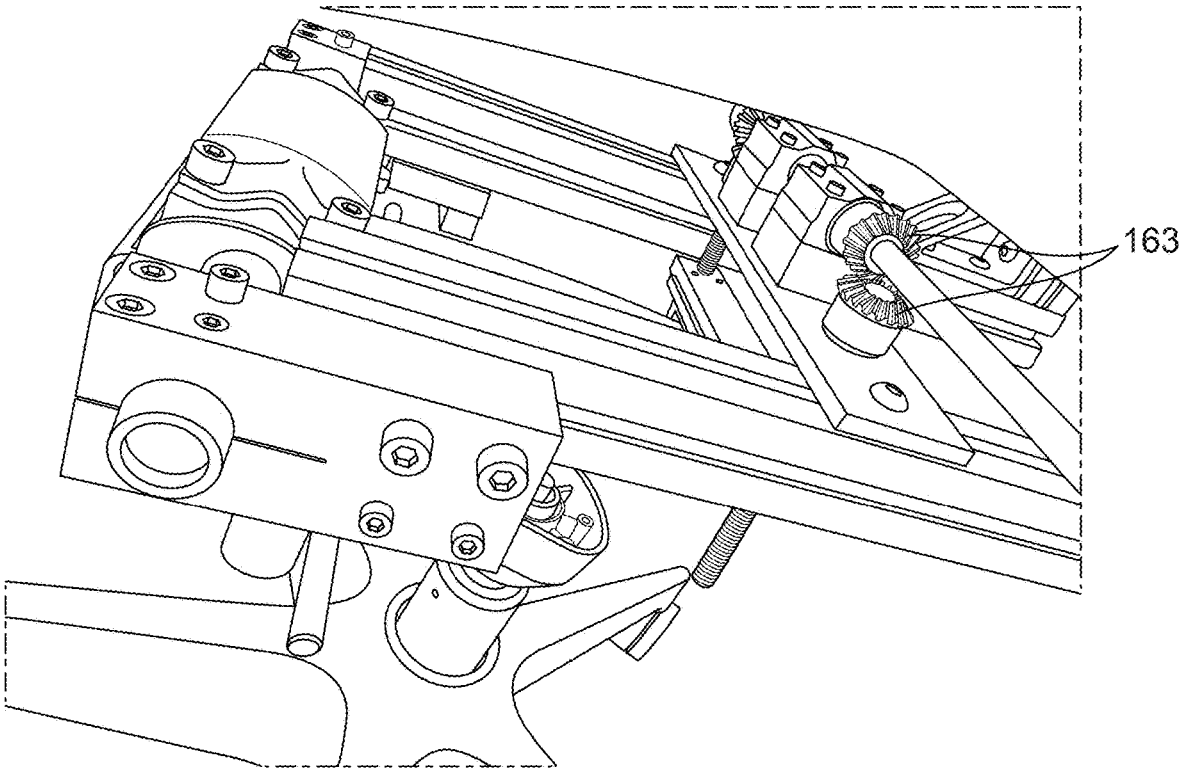
FIGS. 13A and 13B show exemplary implementations of the user adjustable tension adjustment mechanism shown in FIG. 11.
Figure 13B:
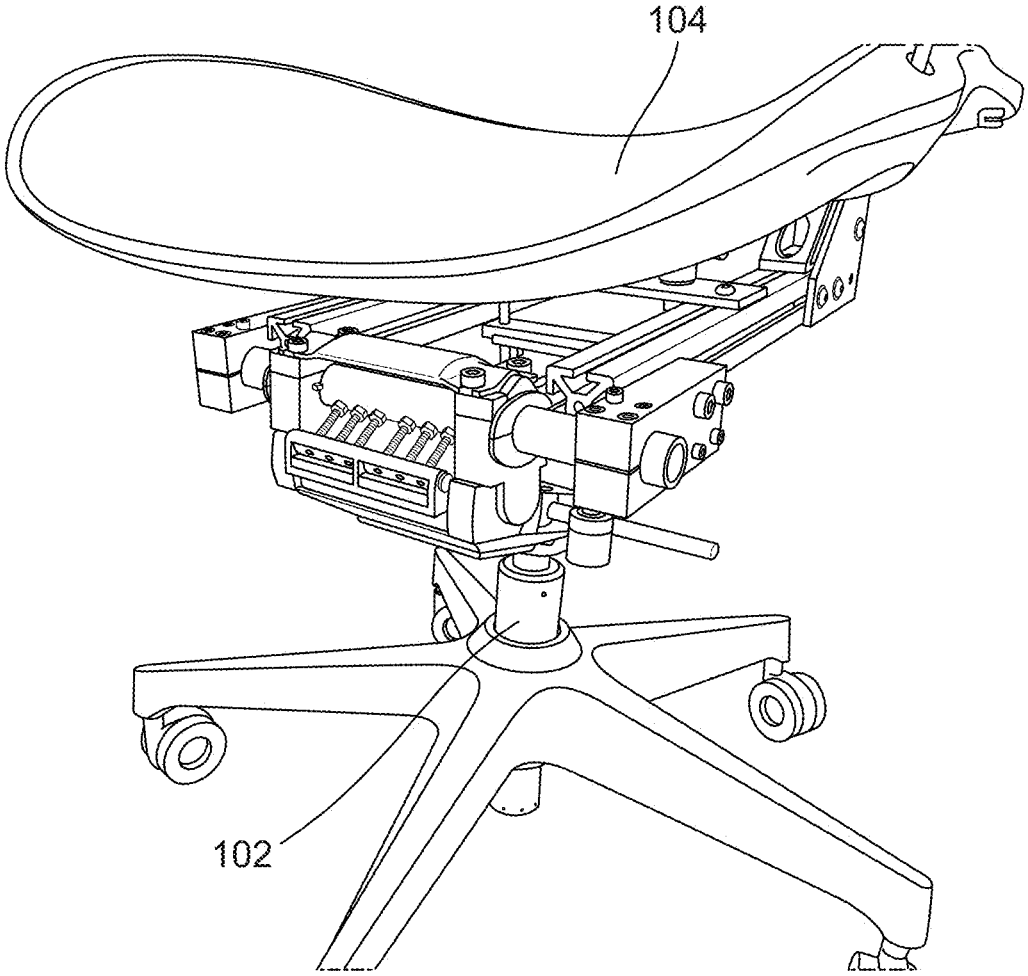
Figure 14:
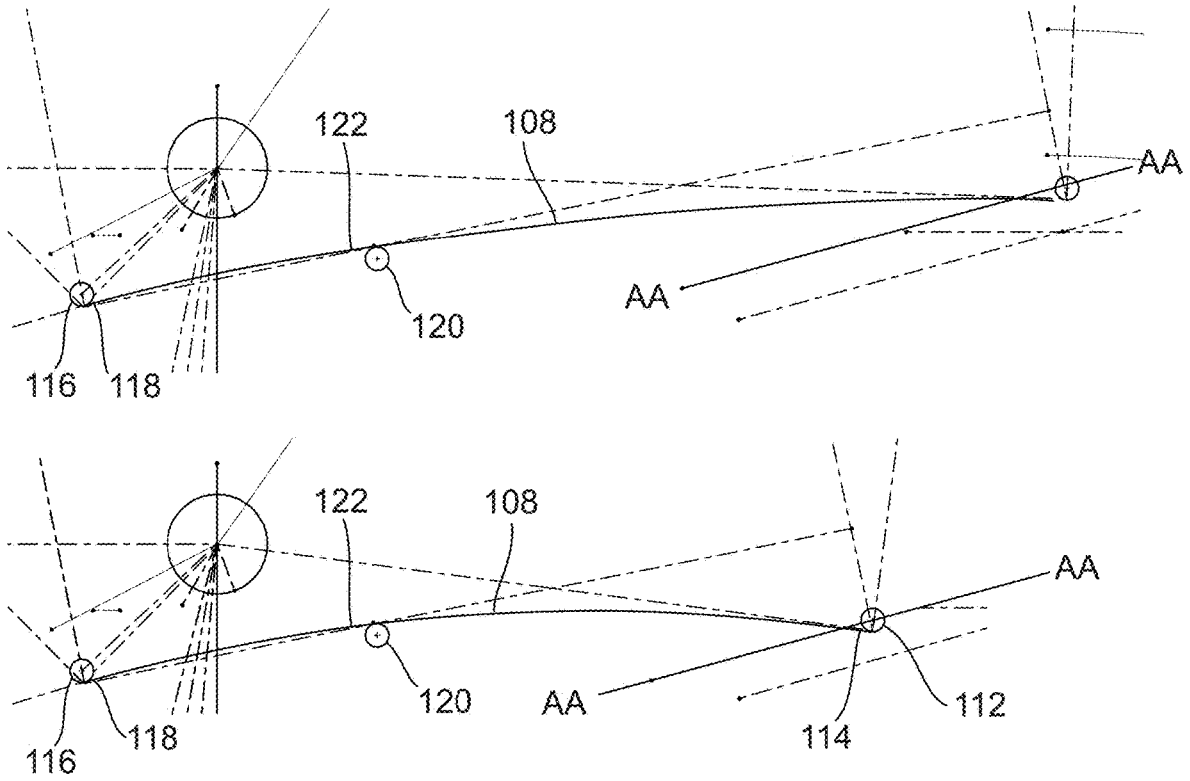
FIG. 14 shows reference sketches of the chair with a quick, user adjustable tension adjustment mechanism in accordance with another embodiment of the present patent application, where the user adjustable tension adjustment mechanism is configured to adjust tension in the leaf spring by adjusting depth of the back/rear point, where some components/portions of the chair are not shown to better illustrate other components/portions of the chair.

FIG. 12 show results of the user adjustable tension adjustment mechanism shown in FIG. 13A and 13B. For example, FIG. 12 shows exemplary results based off of five users having total weights of 96 lbf, 160 lbf, 187 lbf, 196.35 lbf, and 243.1 lbf, respectively and having 'no-leg' weights of 76.8 lbf, 128 lbf, 146 lbf, 153.3 lbf, and 189.8 lbf, respectively. The total weight (in pound-force (lbf)) of each user was obtained by measuring the weight of the user on a weighing scale. The chair 100 was then placed on the weighing scale with the user seated in the chair 100 (on the weighing scale) in a feet flat on the surface (e.g., floor or ground) position. The weight of the user in the later position was obtained and this is the 'no-leg' weight (in lbf) of that user. That is, the 'no-leg' weight of the user is the weight that is measured while the user is sitting in the chair in a feet flat on the ground.

The heights (in inches) of each of the five users were also recorded. The seat vertical force (in lbf)), the back vertical force (in lbf) and a percentage for the back vertical force in comparison to the user's 'no-leg' weight were also recorded for each of the five users at each of the four back/recline angles (e.g., recline angles of 0, 5, 10, and 15 degrees). FIG. 12 shows an exemplary graph showing how much of the user's weight is distributed to their back vs. their overall 'no-leg' weight. The Y-axis of FIG. 12 shows the percentages of back to 'no-leg' weight or the percentages of their legless or seated weight and the X-axis of FIG. 12 shows five users. FIG. 12 shows the weight distribution curves for each of the five users. The differences in the percentages mostly reflect the variance in users' preferences.

Force values based on the geometries for recline angles of 0, 5, 10 and 15 degrees were determined. The preload amount may be adjustable to correlate to five different weight zones, that is, each weight zone to have the same force curve. The preload may be adjusted to achieve desired weight distribution percentages for each weight value.

FIGS. 13A and 13B show exemplary implementations of the user adjustable tension adjustment mechanism shown in FIG. 11. The exemplary implementations/prototypes in FIGS. 13A and 13B use a bevel gear system 163 to push a support bar (the back/rear point/support 112) down (i.e., at the back of the leaf spring 108).

Figure 16A:
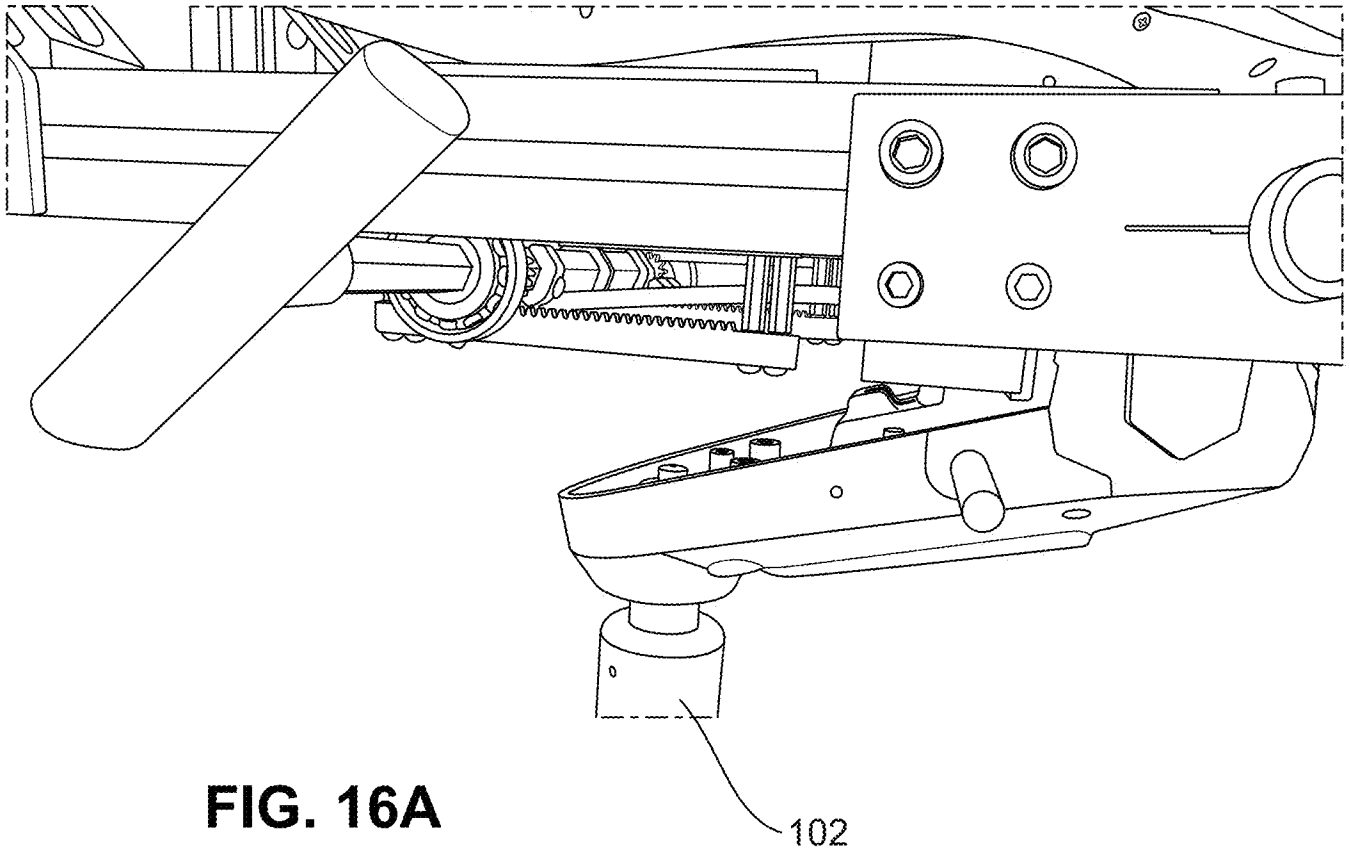
FIGS. 16A and 16B show exemplary implementations of the user adjustable tension adjustment mechanism shown in FIG. 14.
Figure 16B:
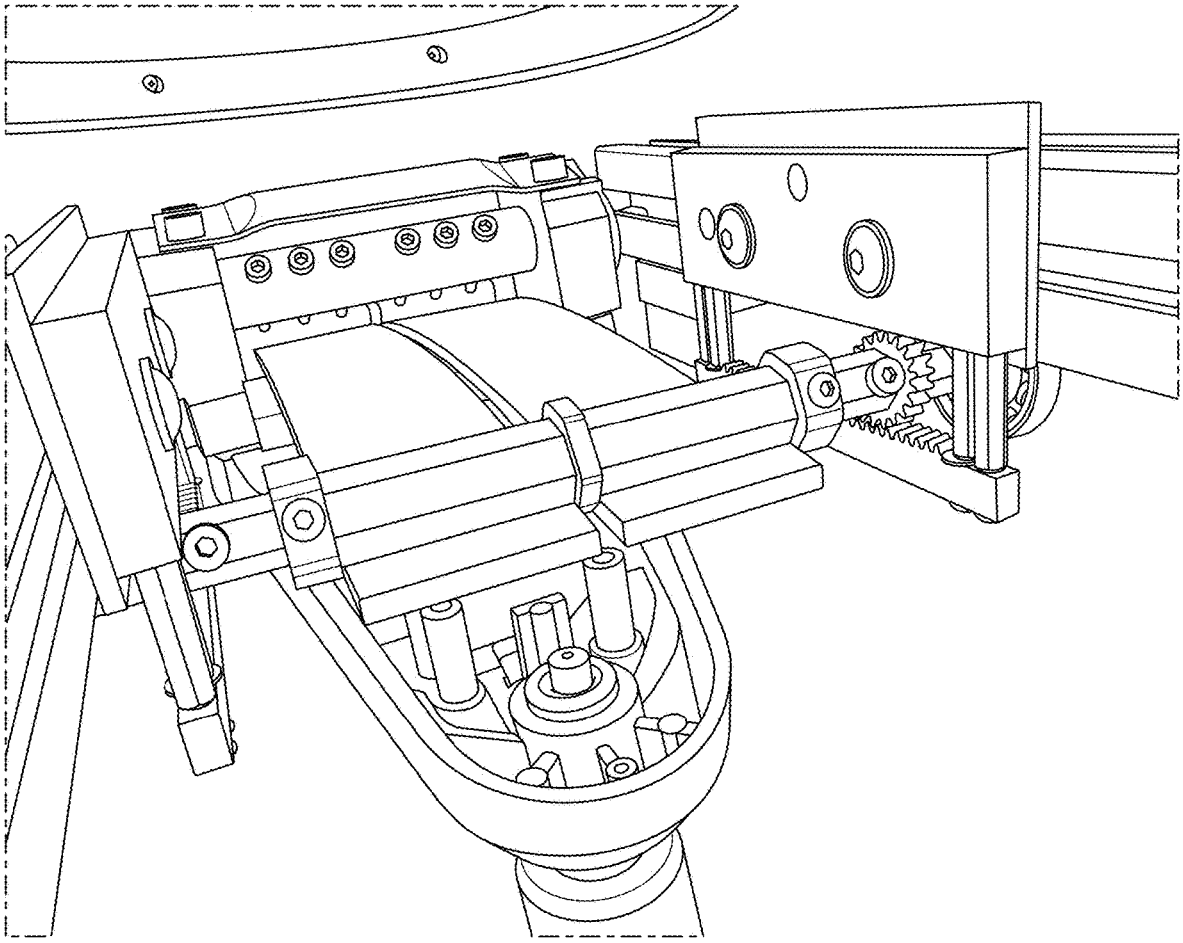

FIG. 14 shows reference sketch views of the chair 100 with another quick, user adjustable tension adjustment mechanism. That is, FIG. 14 shows the reference sketch views for the backside or distal end of the leaf spring 108 using a mechanism as shown in FIGS. 16A and 16B with an angular preload adjustment path that changes the distal engagement point with the leaf spring 108. For example, the user adjustable tension adjustment mechanism is configured to adjust tension in the leaf spring 108 by adjusting depth of the back/rear point/support 112. While adjusting the depth of the rear support 112, the rear support 112 is configured to move along a predetermined angle (e.g., 15 degree angle).

The user may adjust the rear support 112 in or out (along an axis AA-AA with a predetermine angle) before fixedly connecting the rear support 112 to the seat pan 105 (so as to move the rear support 112 along with the seat pan 105 in the forward and rearward tilting directions). Comparing the two figures in FIG. 14, the rear support 112 in the upper figure of FIG. 14 is adjusted to be at an outer position (along the axis AA-AA) before the rear support 112 is fixedly connected to the seat pan 105, while the rear support 112 in the lower figure of FIG. 14 is adjusted to be at an inner position (along the axis AA-AA) before the rear support 112 is fixedly connected to the seat pan 105.

Figure 15:
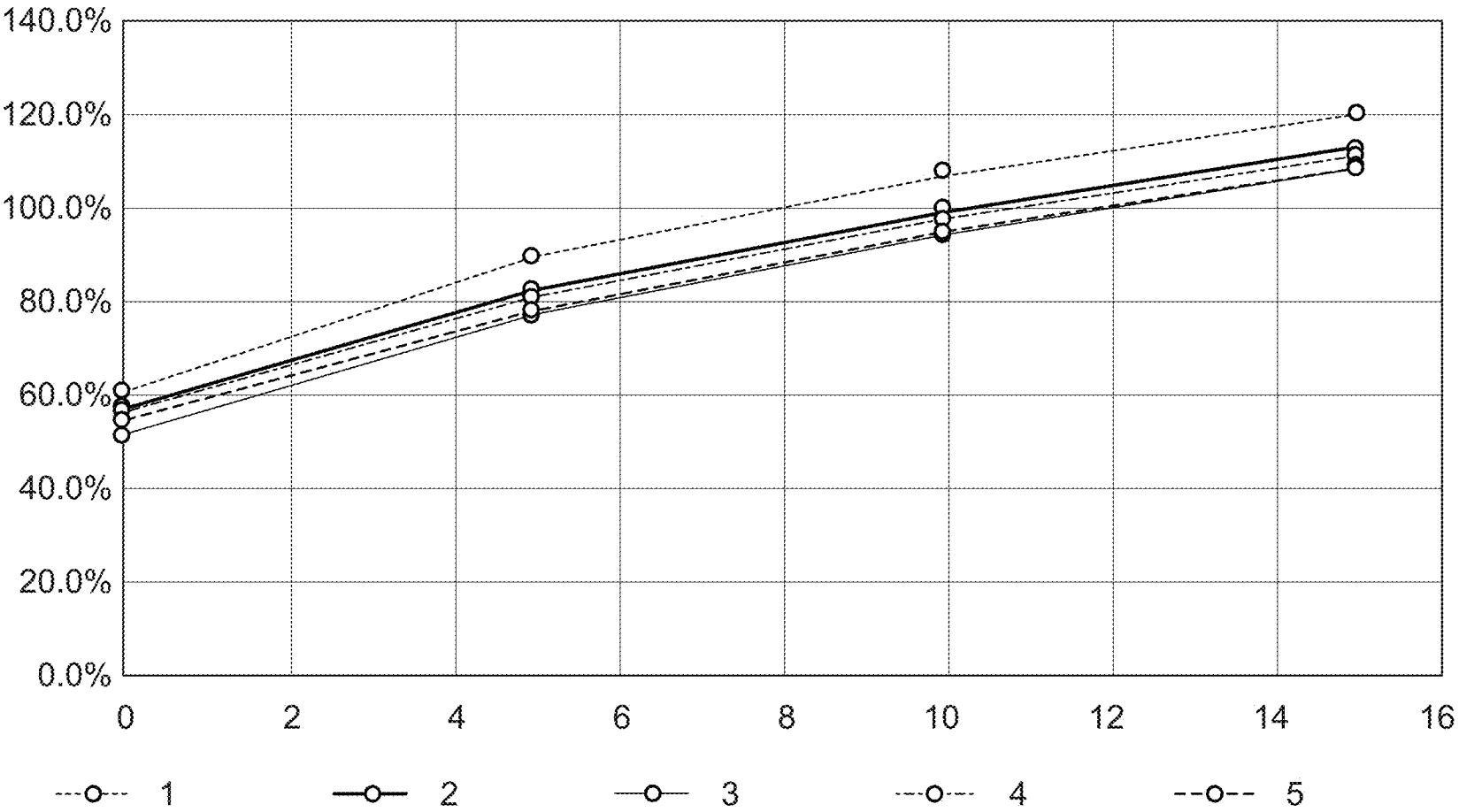
FIG. 15 shows results of the user adjustable tension adjustment mechanism shown in FIGS. 14, 16A and 16B.

FIG. 15 shows results of the user adjustable tension adjustment mechanism shown in FIGS. 16A and 16B. For example, FIG. 15 shows exemplary results for five users having total weights of 96 lbf, 160 lbf, 187 lbf, 196.35 lbf, and 243.1 lbf, respectively and having 'no-leg' weights of 76.8 lbf, 128 lbf, 146 lbf, 153.3 lbf, and 189.8 lbf, respectively. The heights (in inches) of each of the five users were also recorded. The seat vertical force (in lbf)), the back vertical force (in lbf) and percentage back to 'no-leg' weight were also recorded for each of the five users at each of the four back/recline angles (e.g., recline angles 0, 5, 10, and 15 degrees). FIG. 15 shows an exemplary graph showing how much of the user's weight is distributed to their back vs. their overall 'no-leg' weight. The Y-axis of FIG. 15 shows percentage back to 'no-leg' weight or the percentages of their legless or seated weight and the X-axis of FIG. 15 shows the five users. FIG. 15 shows the weight distribution curves for each of the five users. The differences in the percentages mostly reflect the variance in users' preferences.

FIGS. 16A and 16B show exemplary implementations of the user adjustable tension adjustment mechanism shown in FIG. 14. This tension adjustment mechanism relies on a hex bar that is rotated. The flats of the hex bar are configured to act as a 'lock' holding the support bar (e.g., rear support 112) in position. The user has to rotate the hex bar to overcome the radius and reach the next flat. Also, the hex bar jumps flats at max recline/back angles. A torsion spring or something similar may be used along with the hex bar to compensate when rotating to a higher tension configuration, and rotating to a lower tension configuration.

Figure 17A:
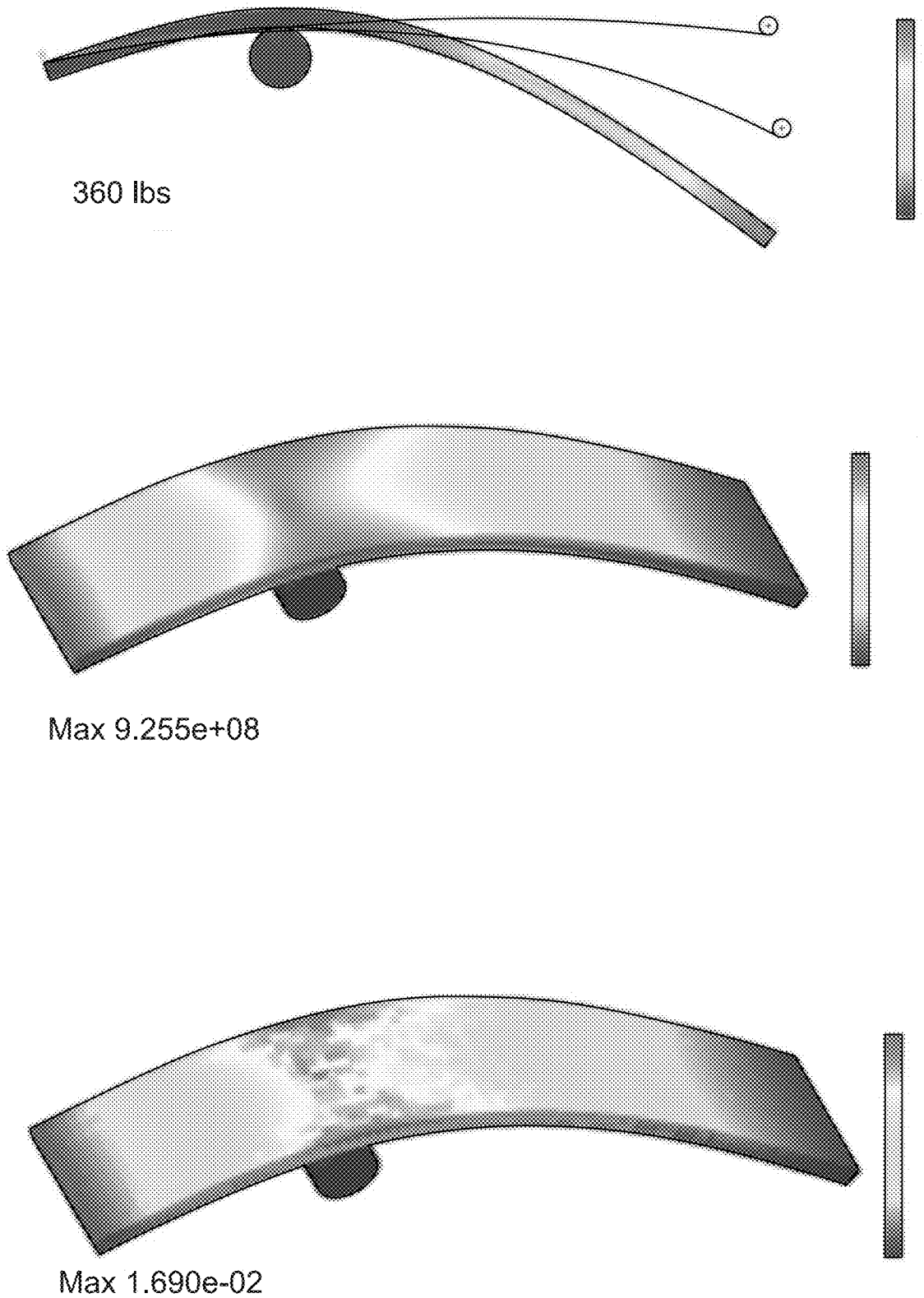
FIG. 17A (PRIOR ART)
FIGS. 17A-17C show exemplary stress distributions along the leaf springs.
Figure 17B:
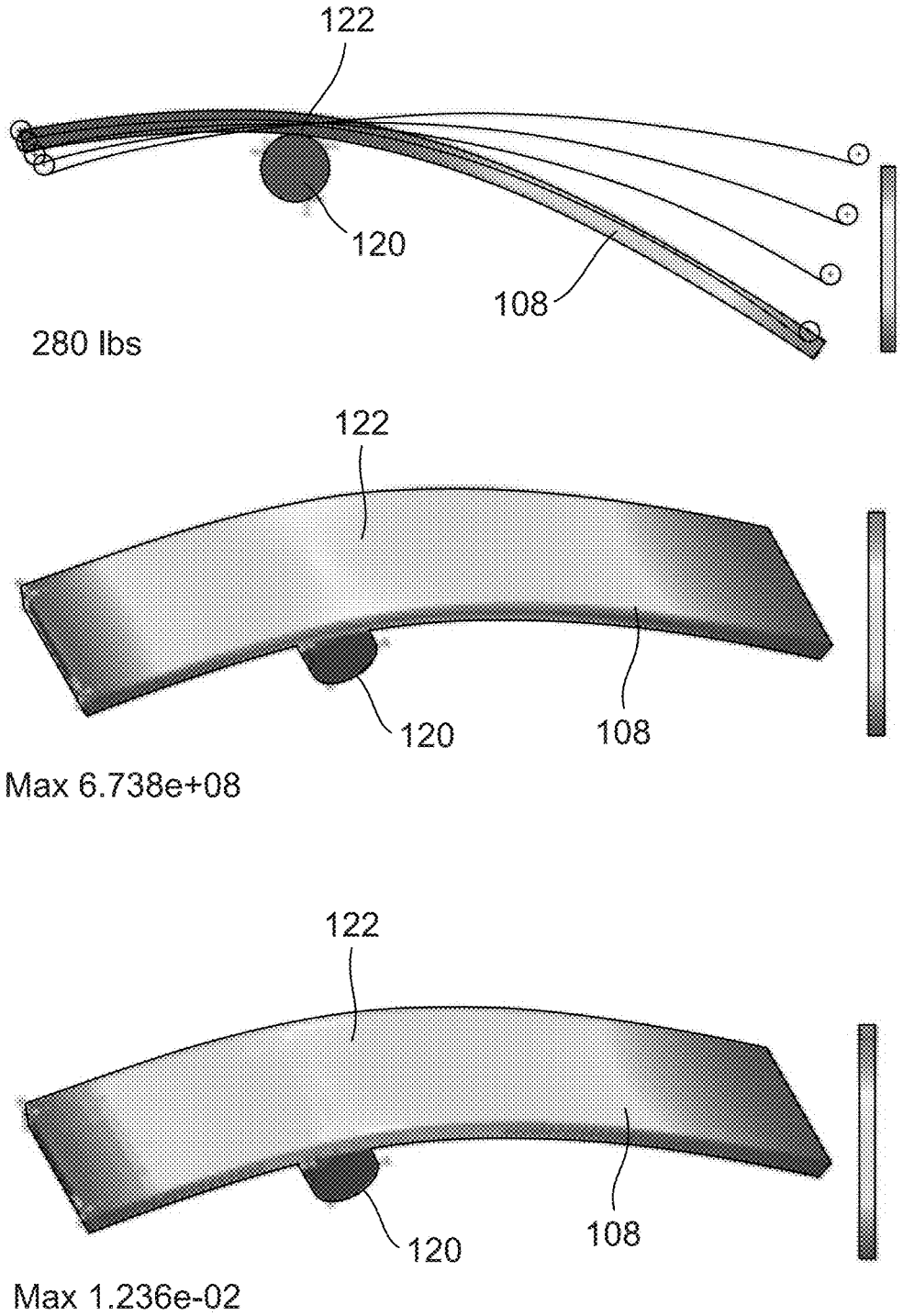
Figure 17C:
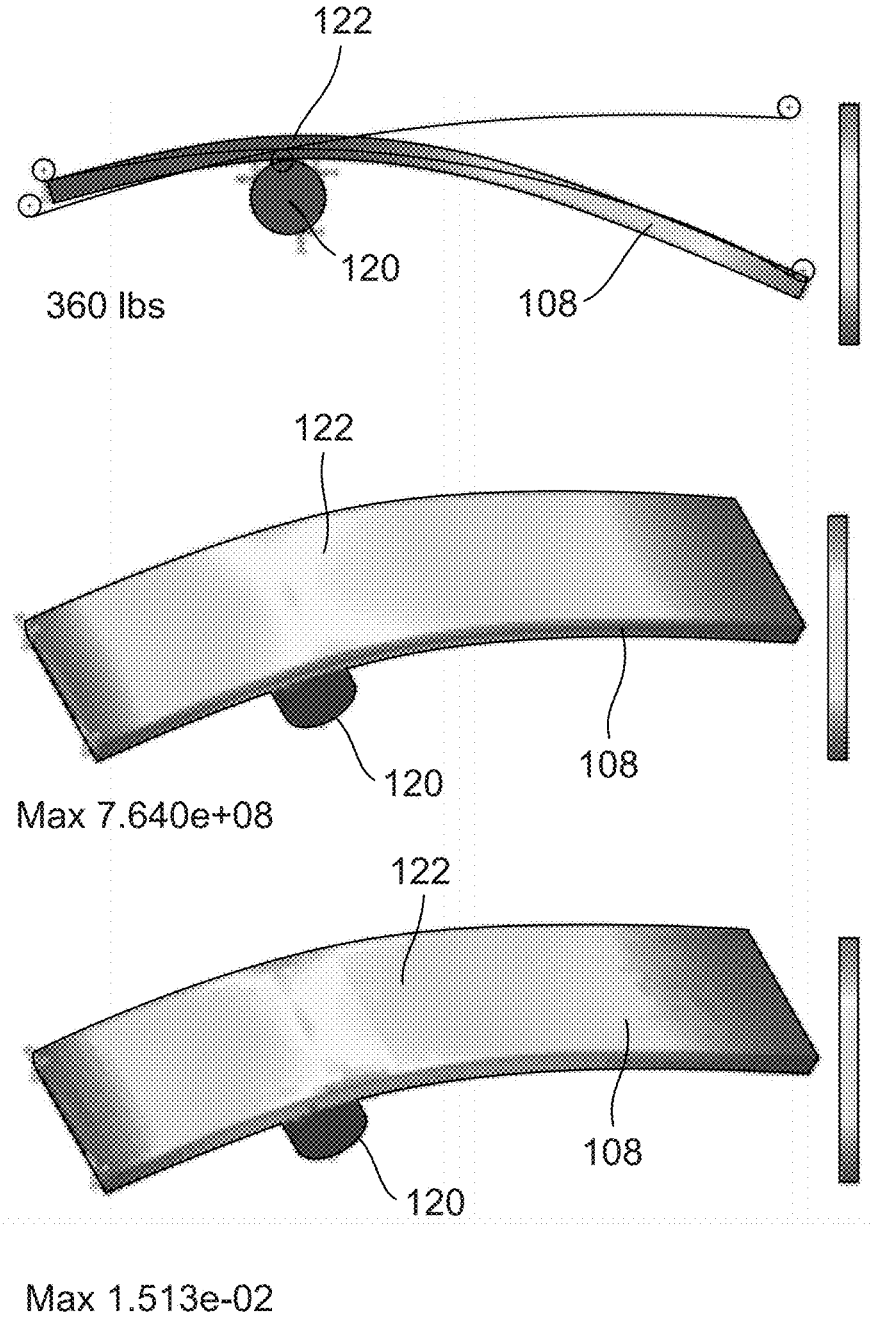

FIGS. 17A-17C show exemplary finite element analysis of the stress distributions along the leaf springs. For example, FIG. 17A shows stress distribution along the prior art leaf spring, while FIGS. 17B-17C show stress distributions along the leaf springs of the present patent application.

As shown in FIG. 17A, in the prior art leaf spring chair system, the preload adjustment was performed by moving the second/intermediate point along the leaf spring. This is the point that is under the highest stress as shown in FIG. 17A. Comparing the prior art leaf spring stress distribution in FIG. 17A with the leaf spring stress distribution of the present patent application in FIG. 17C clearly shows that the stress distribution of the present patent application is distributed evenly along the leaf spring and not very high at the intermediate support 120. FIG. 17A shows the leaf spring stress distribution of the prior art system when subjected to a weight of 360 lbs and with a 30 degree rotation, FIG. 17C shows the leaf spring stress distribution of the present patent application when subjected to a weight of 360 lbs and with 15 degree rotation, while FIG. 17B shows the leaf spring stress distribution of the present patent application when subjected to a weight of 280 lbs, with a preload setting of "10" and with 15 degree rotation.

Figure 18:
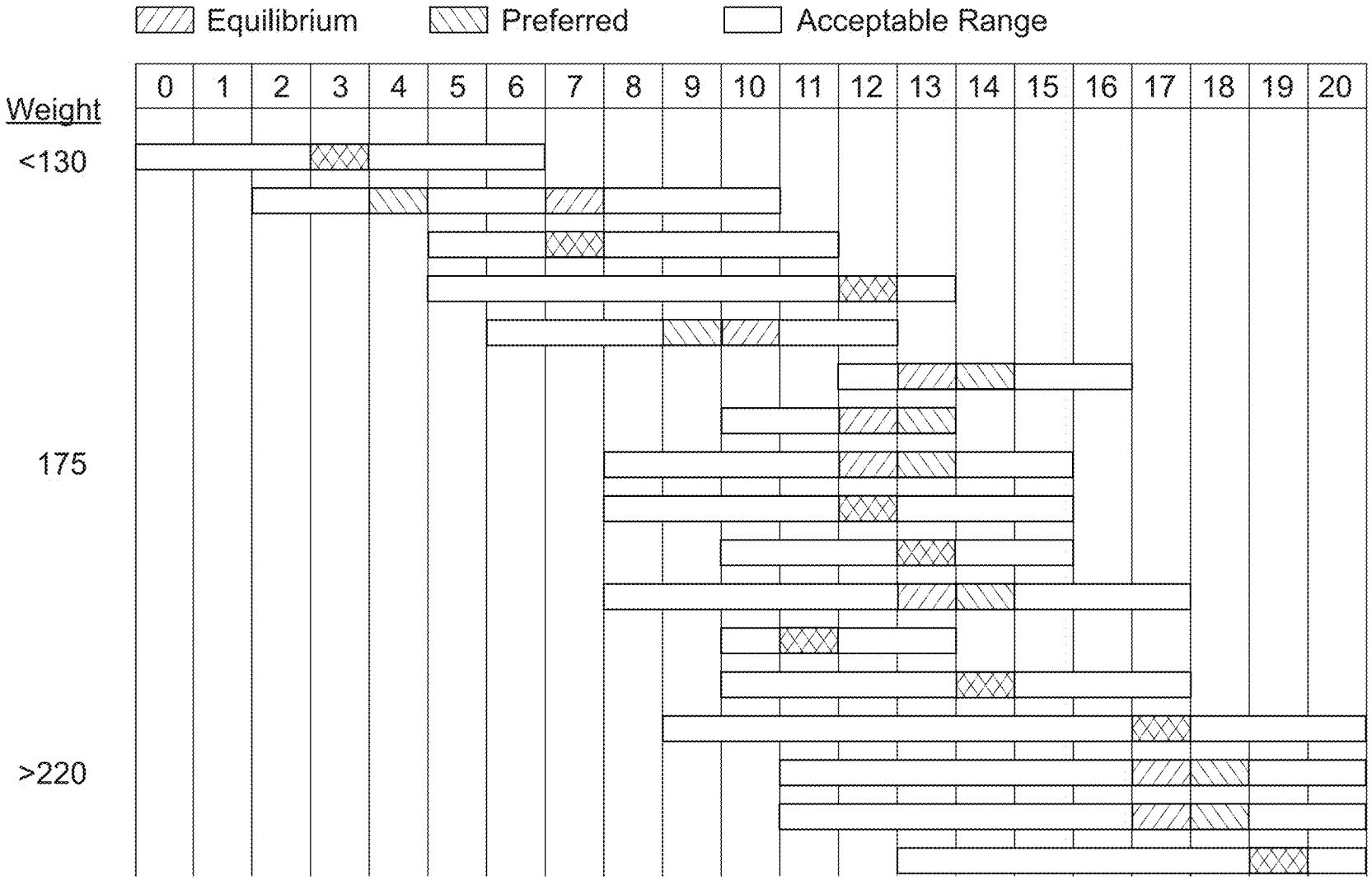
FIG. 18 shows a chart for a user group data that was used to calculate the data in FIGS. 10A, 12 and 15.

FIG. 18 shows a chart for a user group data that was used to calculate the data in FIGS. 10A, 12 and 15. For example, testing was done to establish user's preload preferences for user's weight. In addition, it was attempted to find user's equilibrium (balance point) weight range as well as user's minimum and maximum acceptable weight zone. Equilibrium weight zone/range is when the user's feet left on the ground and the user is positioned at about 15 to 20 degree backward tilt. The chart in FIG. 18 shows the results from this testing. Note that the testing does not include enough people below the 130 lb weight zone. One thing that can be observed from the results in FIG. 18 is that, if a fixed tension around the "10" setting of the test fixture was established, it would accommodate a weight range of about 130-200 pounds.

The chair 100 of the present patent application further comprises the forwardly facing seat back 126. The seat back 126 of the chair 100 may interchangeably referred to as the seat back member. The seat back 126 is configured to support the back of the user while seated in the chair 100. The seat back 126 may be moveable (i.e., pivotable or tiltable) between a normal, upright position and a plurality of rearwardly (e.g., with respect to the seat support structure 106 or the base or base assembly 102) tilted positions. That is, the seat back 126 is configured to be rearwardly tiltable with respect to the seat support structure 106 or the base or base assembly 102.

Each of the plurality of rearwardly tilted positions may have a different degree of tilt/recline of the seat back 126. The user, in accordance with his/her own comfort requirement(s), may select the degree of tilt/recline of the seat back 126. The chair 100 may include a tilt adjustment mechanism that is configured for adjusting the tilt/recline of the seat back 126 and one or more tilt adjustment levers or buttons for adjusting the tilt of the seat back 126. The adjustment button(s)/lever(s) may be easily actuated by the user seated in the chair 100 in order to operate the tilt adjustment mechanism. The chair 100 may include a lock mechanism that may releasably lock the seat back 126 in either the normal, upright position or one of the rearwardly, tilted positions.

The seat back 126 may also include a lumbar support for supporting the lumbar area of the user while seated in the chair 10. The chair 100 may include a moveable lumbar support that moves forward when actuated (either manually or automatically) allowing the user to sit in a more forwardly position on the seat pan 105. The moveable lumbar support provides support to the lower back of the user when the user is in this forwardly seated position. Such a lumbar support is discussed in detail in the '299 Patent.

The seat back 126 and/or lumbar support may include simple padded material, contoured padded material, and engineered breathable mesh material to further provide comfort and support to the user's back. As discussed in detail in the '299 Patent, the chair 100 may include a back recline spring that may be configured to provide resistance to the reclining (tiltable) movement of the seat back 126. Also, as discussed in detail in the '299 Patent, the height of the seat back 126 and/or the lumbar support with respect to the seat base member 104 may be vertically adjusted.

In one embodiment, the seat back 126 and/or the lumbar support are optional.

The chair 100 may include an ergonomic position sensor or sensing arrangement (e.g., with a controller). For example, such an ergonomic position sensor or sensing arrangement is discussed in detail in the '299 Patent. In one embodiment, the ergonomic position sensor or sensing arrangement is optional.

The chair 100 may include headrest. In one embodiment, the headrest may be positioned above the seat back 126. The headrest may be adjustable in both its angle and its height. For example, the headrest may be configured to be moved forward, rearward, at an angle, upward and/or downward to support the user's head (when the user is seated in the chair 100). For example, such a headrest is discussed in detail in the '299 Patent.

The chair 100 may include a pair of armrests 138. The armrests 138 are positioned on sides of the chair 100. The armrests 138 may be adjustable in their height so that the height of the armrests 138 is adjusted to support the user's arms. In one embodiment, the armrest 138 may be stationary. In another embodiment, the armrests 138 may be movable or pivotable between a horizontal, use (armrest) position (as shown in FIG. 1) and a vertical, stored position (i.e., flush with the seat back 126). In one embodiment, the headrest and the armrests 138 may be cushioned (with varying firmness and contours) to provide increased comfort to the user's head, neck and the arms, respectively. The headrest and armrests 138 may be ergonomically designed to provide comfort and support to the user's neck, head and arms, respectively. The headrest and the armrest 138 may include simple padded material, contoured padded material and engineered breathable mesh material to further provide comfort and support to the user's neck, head and the arms, respectively.

In one embodiment, the headrest and/or the armrest 138 are optional.

The present patent application and its various embodiments as described above uniquely address the observed, noted and researched findings and improve on the prior and current state of the art systems. The listed products, features and embodiments as described in the present patent application should not be considered as limiting in any way.

Although the present patent application has been described in detail for the purpose of illustration, it is to be understood that such detail is solely for that purpose and that the present patent application is not limited to the disclosed embodiments, but, on the contrary, is intended to cover modifications and equivalent arrangements that are within the spirit and scope of the appended claims. In addition, it is to be understood that the present patent application contemplates that, to the extent possible, one or more features of any embodiment can be combined with one or more features of any other embodiment.

The illustration of the embodiments of the present patent application should not be taken as restrictive in any way since a myriad of configurations and methods utilizing the present patent application can be realized from what has been disclosed or revealed in the present patent application. The systems, features and embodiments described in the present patent application should not be considered as limiting in any way. The illustrations are representative of possible construction and mechanical embodiments and methods to obtain the desired features. The location and/or the form of any minor design detail or the material specified in the present patent application can be changed and doing so will not be considered new material since the present patent application covers those executions in the broadest form.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Terms of degree such as "generally," "substantially," "approximately," and "about" may be used herein when describing the relative positions, sizes, dimensions, or values of various elements, components, regions, layers and/or sections. These terms mean that such relative positions, sizes, dimensions, or values are within the defined range or comparison (e.g., equal or close to equal) with sufficient precision as would be understood by one of ordinary skill in the art in the context of the various elements, components, regions, layers and/or sections being described.

The foregoing illustrated embodiments have been provided to illustrate the structural and functional principles of the present patent application and are not intended to be limiting. To the contrary, the present patent application is intended to encompass all modifications, alterations and substitutions within the spirit and scope of the appended claims.

What is claimed is:

1. A chair comprising:

a base;

a seat comprising an upwardly facing seat pan and a forwardly facing seat back;

a seat support structure mounted to the base beneath the seat, the seat being movable in a rearward tilting direction from a substantially horizontal position through a range of rearwardly tilted positions;

a leaf spring disposed between the seat support structure and the seat for biasing the seat in a forward tilting direction towards the substantially horizontal position;

an adjustment mechanism configured to adjust a force curve of the leaf spring, the adjustment mechanism comprising:

a rear support operatively associated with a rear end portion of the leaf spring and connected to the seat;

a front support operatively associated with a front end portion of the leaf spring and connected to the seat support structure; and an intermediate support disposed between the front support and the rear support, the intermediate support operatively associated with an intermediate portion of the leaf spring and configured to support the intermediate portion of the leaf spring thereon, wherein the leaf spring is bowed over the intermediate support concave downwardly between the front and rear end portions thereof to generate a spring reaction force such that an upward force is applied to the rear support by the rear end portion of the leaf spring to bias the seat in the forward tilting direction;

wherein the front support is mounted to move at least vertically in response to the seat moving in the forward and rearward tilting directions to enable (a) the front end portion of the leaf spring to deflect upwardly for relieving at least a portion of an increase in the spring reaction force induced by downward movement of the rear support as the seat moves in the rearward tilting direction through the range of rearwardly tilted positions, and (b) the front support to deflect the front end portion of the leaf spring downwardly for restoring at least a portion of a decrease in the spring reaction force induced by upward movement of the rear support as the seat moves in the forward tilting direction through the range of rearwardly tilted positions.

2. The chair according to claim 1, wherein the adjustment mechanism comprises a control member connected to the seat for movement therewith as the seat moves in the forward and rearward tilting directions, the front support being connected to the control member such that the control member moves the front support at least vertically in response to the seat moving in the forward and rearward tilting directions.

3. The chair according to claim 2, wherein the control member is a pivotable control arm pivotally connected to the seat support structure and connected to the seat for pivotal movement as the seat moves in the forward and rearward tilting directions.

4. The chair according to claim 1, wherein the seat support structure is mounted to the base beneath the seat pan, and wherein the seat pan is movable in the rearward tilting direction from the substantially horizontal position through the range of rearwardly tilted positions.

5. The chair according to claim 4, wherein the leaf spring is disposed between the seat support structure and the seat pan for biasing the seat pan in the forward tilting direction towards the substantially horizontal position.

6. The chair according to claim 5, wherein the rear support of the adjustment mechanism is operatively associated with the rear end portion of the leaf spring and is connected to the seat pan;

wherein the leaf spring is bowed over the intermediate support of the adjustment mechanism concave downwardly between the front and rear end portions thereof to generate the spring reaction force such that the upward force is applied to the rear support of the adjustment mechanism by the rear end portion of the leaf spring to bias the seat pan in the forward tilting direction; and wherein the front support is mounted to move at least vertically in response to the seat pan moving in the forward and rearward tilting directions to enable (a) the front end portion of the leaf spring to deflect upwardly for relieving at least a portion of an increase in the spring reaction force induced by downward movement of the rear support as the seat pan moves in the rearward tilting direction through the range of rearwardly tilted positions, and (b) the front support to deflect the front end portion of the leaf spring downwardly for restoring at least a portion of a decrease in the spring reaction force induced by upward movement of the rear support as the seat pan moves in the forward tilting direction through the range of rearwardly tilted positions.

7. The chair according to claim 6, wherein the adjustment mechanism comprises a control member connected to the seat pan for movement therewith as the seat pan moves in the forward and rearward tilting directions, and wherein the front support is connected to the control member such that the control member moves the front support at least vertically in response to the seat pan moving in the forward and rearward tilting directions.

8. The chair according to claim 7, wherein the control member is a pivotable control arm pivotally connected to the seat support structure and connected to the seat pan for pivotal movement as the seat pan moves in the forward and rearward tilting directions.

9. The chair according to claim 1, further comprising:

a movement support frame, the movement support frame being supported on the base; and at least two movement support members configured to operatively connect the seat pan to the movement support frame, wherein the seat pan is suspended in the movement support frame, wherein the seat support structure includes the movement support frame, wherein the leaf spring is disposed between the seat support structure and the movement support frame from which the seat pan is suspended, and wherein the seat back is operatively connected to the movement support frame.

* * * * *